US012471724B2

(12) United States Patent
Kelly et al.

(10) Patent No.: US 12,471,724 B2
(45) Date of Patent: Nov. 18, 2025

(54) TRAVEL PILLOW DEVICE, AND METHOD OF MANUFACTURE

(71) Applicants: Debbie Kelly, Aurora, CO (US); Da Lesha M Allen, Aurora, CO (US)

(72) Inventors: Debbie Kelly, Aurora, CO (US); Da Lesha M Allen, Aurora, CO (US)

( * ) Notice: Subject to any disclaimer, the term of this patent is extended or adjusted under 35 U.S.C. 154(b) by 185 days.

(21) Appl. No.: 17/593,057

(22) PCT Filed: Apr. 17, 2021

(86) PCT No.: PCT/US2021/070345

§ 371 (c)(1),
(2) Date: Sep. 8, 2021

(87) PCT Pub. No.: WO2022/220888

PCT Pub. Date: Oct. 20, 2022

(65) Prior Publication Data

US 2022/0378233 A1 Dec. 1, 2022

(51) Int. Cl.
*A47G 9/10* (2006.01)
*A47G 9/02* (2006.01)

(52) U.S. Cl.
CPC ..... *A47G 9/1045* (2013.01); *A47G 9/0223* (2013.01)

(58) Field of Classification Search
CPC ..... A47G 9/0223; A47G 9/0253; A47G 9/06; A47G 9/066; A47G 9/10; A47G 9/1045; A47C 7/383; A47C 21/026; A45C 9/00; A45C 2009/002; A45F 2004/026; A41D 15/04

See application file for complete search history.

(56) References Cited

U.S. PATENT DOCUMENTS

| | | | | | |
|---|---|---|---|---|---|
| 4,991,245 | A * | 2/1991 | Franco | A47G 9/062 | 5/490 |
| 5,047,001 | A * | 9/1991 | Willis | A47G 9/10 | 112/475.08 |
| 5,652,983 | A * | 8/1997 | Kraemer | A47G 9/0253 | 5/639 |
| 5,940,909 | A * | 8/1999 | Sapp | A47G 9/0253 | 5/490 |
| 6,687,931 | B1 * | 2/2004 | Benavides | A01K 1/0353 | 5/490 |
| 2015/0113734 | A1 * | 4/2015 | Arabo | A47G 9/109 | 5/636 |
| 2019/0290033 | A1 * | 9/2019 | Lonstein | A47G 9/10 | |
| 2020/0069086 | A1 * | 3/2020 | Little | B68G 1/00 | |
| 2020/0077818 | A1 * | 3/2020 | Wang | A47G 9/10 | |
| 2020/0154913 | A1 * | 5/2020 | Montes | A47G 9/0223 | |

* cited by examiner

*Primary Examiner* — David R Hare
*Assistant Examiner* — George Sun
(74) *Attorney, Agent, or Firm* — Carson Patents

(57) ABSTRACT

The present invention is a travel pillow device, and a method of manufacture for a travel pillow comprised of five fabric layers wherein the first two fabric layers are stacked and folded to create a stuff-able pillow pocket, the third fabric layer is folded and stacked in alignment with the pillow pocket forming an exterior pocket, the fourth fabric layer is folded and stacked in alignment with the pillow pocket and exterior pocket forming an interior pocket, and the fifth fabric layer is formed into a strap and attached to the underside of the interior pocket wherein the edges of the stack of folded fabric elements are sewn in a single sewing operation and then the pillow pocket is then stuffed and the interior pocket is pulled inside out forming a travel pillow.

4 Claims, 22 Drawing Sheets

TRAVEL PILLOW DEVICE, AND METHOD OF MANUFACTURE

TECHNICAL FIELD OF THE INVENTION

This invention relates generally to a travel pillow with pockets for storing a blanket. This invention relates more specifically to a travel pillow with pockets and a carry strap for convenient travel.

This invention relates generally to a method to manufacturing a travel pillow with an interior pocket and an exterior pocket in the form of a sequence of steps that minimizes sewing operations and maximizes adjustability of the final travel pillow size/scale.

BACKGROUND

There exists today many pillows. Many of which can be used as travel pillow. There are travel pillow and blanket combinations. What there is not is a fast, highly repeatable, simple, and scalable-in-size method of making travel pillows with interior and exterior pockets.

In light of the foregoing prior art, there is a need for a method of manufacturing a travel pillow that is fast, highly repeatable, simple, and scalable-in-size (permitting many sizes) having a minimum of sewing operations to complete to better and more consistently manufacturer travel pillows with pockets.

BRIEF SUMMARY OF THE INVENTION

According to an aspect of the invention there is a travel pillow device for transporting a pillow and blanket, comprising: a pillow bag having an opening to pass through a pillow, and a stowage sack having an opening to pass through the pillow bag and a reversible surface, wherein the pillow bag has a first attachment to the reversible surface which turns outside-in to cover the opening of the pillow bag.

So the pillow gets captured in the pillow bag by the reversed inside-out stowage sack which is conveniently positioned to receive a blanket in through its open end. By carrying the travel pillow device person carries both the captured pillow and stowed blanket at once.

According to a another aspect of the invention there is a travel pillow device for transporting goods comprising a pillow having a first edge, a second edge, a third edge, and fourth edge of a top side and a bottom side, a stowage sack dimensioned to match said top side of said pillow connectively attached to said pillow along said first edge, said second edge, said third edge, and having an opening for stowage along said fourth edge, a pocket connectively attached to said stowage sack, and a strap connectively attached to said stowage sack.

According to a another aspect of the invention there is a travel pillow device for transporting goods comprising a pillow having a first edge, a second edge, a third edge, and fourth edge, a top side and a bottom side, a stowage sack dimensioned to match said top side of said pillow connectively attached to said pillow along said first edge, said second edge, said third edge, and having an opening for stowage along said fourth edge, a pocket connectively attached to said stowage sack, and a strap connectively attached to said stowage sack further comprising a plurality of attachment anchors connectively attached to at least one of said edges of said pillow.

The travel pillow device may be arranged in a first configuration wherein said stowage sack is turned inside with the reversible surface is turned inside-out to uncover said opening in the pillow bag. So the pillow may be easily put into and taken out of the pillow bag.

The travel pillow device may comprise a pillow. The travel pillow device may be placed in a second configuration wherein the stowage sack reversible surface is turned outside-in to capture the pillow in the pillow bag. This the pillow does not inadvertently fall out while a person is traveling with it. The travel pillow device may comprise a blanket or be used carry or stow a blanket. The travel pillow device may be arranged in the second configuration wherein the stowage sack reversible surface is turned outside-in to stow the blanket intermediate the pillow bag and the reversible surface.

Preferably the first attachment is proximate a closed end of the stowage sack. So by inserting the pillow bag into the storage sack a whole length of the stowage sack from closed end to the opening the stowage sack is used to enclose the pillow bag. Said closed end of the stowage sack may be distal from the opening in the stowage sack to pass through the pillow bag.

The stowage sack may be large enough to envelope the pillow bag filled by a pillow. The stowage sack may longer from its opening to a closed end of the stowage sack than the pillow bag from a closed end of the pillow bag to its opening.

Alternatively a length of the stowage sack from a closed end of the stowage sack to its opening may be only fifty to ninety-nine percent of a length of the pillow bag from a closed end of the pillow bag to its opening. Thus in the second configuration a portion of the pillow is left exposes since the stowage sack only covers fifty to ninety-nine percent of the length.

The stowage sack may comprise a stretchable material to stretch over the pillow bag filled by the pillow.

The pillow bag and the storage sack may be rectangular so as accommodate a rectangular pillow a traveller may be used to resting upon. The first attachment may be to a rectangular edge of the stowage sack that is a closed end of the stowage sack parallel and opposite to a rectangular edge where there is the opening of the stowage sack.

The travel pillow device may comprise a satchel having an opening to intake goods and a second attachment to the pillow bag proximate the first attachment. A blanket may be stowed in said satchel. The satchel may comprise a fabric sheet that is folded in half with the folded end aligned along the open end of the pillow bag. In use in the second configuration the satchel may be interleaved intermediate the reversible surface and the pillow bag. In the second configuration the stowage sack reversible surface may be turned outside-in to interleave the satchel. The satchel may be shorter that the stowage sack from opening of the stowage sack to distal closed of the stowage sack. So the whole satchel may be within the stowage sack in the second configuration. The fabric sheet forming the satchel may be folded in half to have a length at least half to at most ninety percent of the length pillow bag to its closed end. The fabric sheet forming the satchel may be folded in half to have a length at least half to at most ninety percent of the length pillow bag to its closed end.

The pillow bag and storage sack may comprise a single fabric sheet wherein the first attachment comprises a fold in the sheet. So only a single sheet may be required to make the travel pillow device.

The pillow bag may comprise a first fabric sheet and a second fabric sheet layered together and joined along the attachment.

The pillow bag may comprise a first fabric sheet having a first fold where it is folded in half, wherein the attachment is aligned along the first fold. The stowage sack may comprise a third fabric sheet having a second fold where it is folded in half, wherein the second fold is aligned along the first fold. So the travel pillow device may be efficiently made by steps including folding sheets to make the pillow bag and storage sack.

The travel pillow device may comprise a strap attached to the stowage sack. The strap the strap may be disposed along an edge of the opening of the stowage sack. The strap may be affixed to a surface of the stowage sack on an opposite side from the reversible surface proximate the opening of the stowage sack to pass through the pillow bag.

The stowage sack may comprise a third fabric sheet having a second fold where it is folded in half, wherein the first attachment is aligned along the second fold.

According to another aspect of the invention there is a method of manufacturing a travel pillow device including aligning and layering together a pillow bag having an opening to pass through a pillow and a stowage sack having an opening to pass though the pillow bag, attaching a reversible surface of the stowage sack turned outwards to an attachment on the pillow bag, inserting a pillow into the pillow bag through the opening to pass through a pillow, and turning stowage sack inside-out over the pillow bag to cover the open-ing of the pillow bag with the pillow bag capturing the pillow inside the pillow bag.

So by simply connecting a pillow bag to stowage sack with the open ends of the pillow bag and the stowage sack directed to opposite distal ends and reversing the stowage sack over the open end of the pillow bag, a travel pillow device can be made in which the pillow is captured and a blanket may be conveniently stowed in the stowage sack. The pillow travel device may also comprise satchel described above. So turning stowage sack inside-out over the pillow bag to cover the open-ing of the pillow bag with the pillow bag capturing the pillow inside the pillow bag may have an additional consequence of capturing the satchel inside the pillow bag interleaved between the reversible surface sack and the pillow bag.

According to another aspect of the invention there is a method of making a travel pillow, the method comprising making a pillow bag layer having a closed end and an open end comprising a first rectangular sheet and second rectangular sheet each having a first end, a second end, a length and a width comprising a first fabric and a second fabric respectively dimensioned equally by aligning and layering together said first rectangular sheet and said second rectangular sheet and forming a single layer, folding in half said single layer by aligning together and flattening said first ends and said second ends of said rectangular sheets forming said pillow bag layer having its open end between said first ends and said second ends of said rectangular sheets and its closed end along said single layer where folded in half.

The method may also include folding in half a third rectangular sheet having a width, a length, a first side and a second side comprising a third fabric dimensioned to match said width of said first rectangular sheet and said second rectangular sheet and a length at least one percent less long as said length of said first rectangular sheet and said second rectangular sheet wherein said third rectangular sheet is folded in half by aligning together said first side and said second side of said third rectangular sheet and flattening forming an open end and a closed end in the third rectangular sheet as folded. The third rectangular sheet as folded may be stacked on top of said pillow bag layer with said open end of said third rectangular sheet as folded aligned along said closed end of said pillow bag layer disposing the closed end of said third rectangular sheet as folded proximal to said open end of said pillow bag layer. The third rectangular sheet as folded may be stacked leaving a sewing edge on said open end of said pillow bag layer not to include the closed end of said third rectangular sheet as folded.

The method may include folding in half a fourth rectangular sheet having a first end, a second end, and a width dimensioned equally to said first rectangular sheet and said second rectangular sheet and a length at least one percent less long as the length of said first rectangular sheet and said second rectangular sheet. The fourth rectangular sheet may comprise a fourth fabric. Said fourth rectangular sheet may be folded in half by aligning together said first end and said second end and flattening. The fourth rectangular sheet as folded is this way formed having an open end where the first and second ends of the fourth rectangular sheet are aligned. The fourth rectangular sheet has a closed end along where folded.

The method may include connectively attaching a strap having a first end and a second end comprising a fifth fabric wherein said first end and said second end of said strap are connectively attached to the under/bottom side of said fourth rectangular sheet as folded proximal to said closed end of said fourth rectangular sheet as folded.

The method may include stacking said fourth rectangular sheet as folded on top of said third rectangular sheet as folded It may include aligning said open end of said fourth rectangular sheet as folded along said closed end of said pillow bag layer. So it may include forming a fabric stack having four sides. The first side of said fabric stack may consist of at least the side where the open end of said pillow bag layer aligns and presents a sewing edge not to include said closed end of said folded fourth rectangular sheet. All sides of said fabric stack may then be sewn together starting at either corner having an edge adjacent to said first side of said fabric stack. The method may include sewing around all edges of said fabric stack pausing the sewing about halfway across said first side of said fabric stack and inserting a pillow fill into said pillow bag layer at its open end and prior to then completing the sewing all the way around said fabric stack thereby creating a stowage sack between said fourth rectangular sheet as folded and said pillow bag layer open at the first side of said fabric stack.

The sewing stowage sack may be reversed to reveal its inner surface turned outwards. Said stowage sack may be reversed to expose said strap. Said stowage sack may be reversed exposing said third rectangular sheet as folded. Said stowage sack may be reversed to dispose said stowage sack between said fourth rectangular sheet as folded and said pillow bag layer open at the first side of said fabric stack.

According to a fourth aspect of the invention there is a method of making a travel pillow further comprising inserting a plurality of attachment anchors between said fourth rectangular sheet as folded and said pillow bag layer proximal to said open end of said pillow bag layer. The method may include connectively attaching said attachment anchors to said fourth rectangular sheet as folded and to said pillow bag layer prior to sewing said sides of said fabric stack.

An advantage of the manufacturing method is the minimizing of sewing operations to only one or two sewing steps while still being adjustable so as to accommodate the creation of many different sizes.

The invention will now be described, by way of example only, with reference to the accompanying drawings in which:

DETAILED DESCRIPTION

The detailed embodiments of the present invention are disclosed herein. The disclosed embodiments are merely exemplary of the invention, which may be embodied in various forms. The details disclosed herein are not to be interpreted as limiting, but merely as the basis for the claims and as a basis for teaching one skilled in the art how to make and use the invention.

References in the specification to "one embodiment," "an embodiment," "an example embodiment," etcetera, indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to effect such feature, structure, or characteristic in connection with other embodiments whether or not explicitly described.

Furthermore, it should be understood that spatial descriptions (e.g., "above," "below," "up," "left," "right," "down," "top," "bottom," "vertical," "horizontal," etc.) used herein are for purposes of illustration only, and that practical implementations of the structures described herein can be spatially arranged in any orientation or manner.

Figure 1:
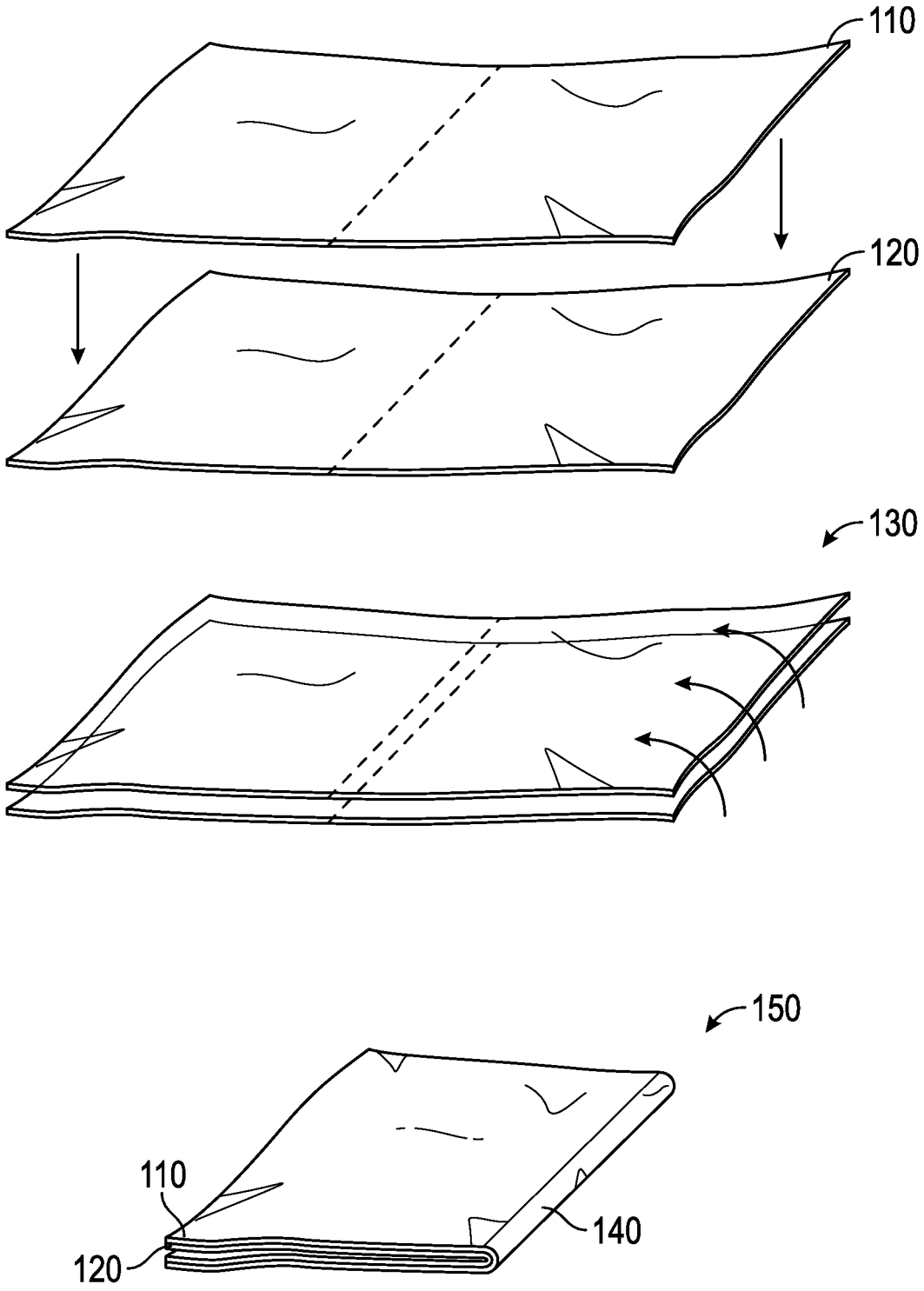
FIG. 1 is a perspective view illustrating forming of a pillow bag layer by the first rectangular sheet and the second rectangular sheet being stacked together into single layer and folded to become a pillow bag layer having a pillow pocket and prepared for assembly according to the invention.

A travel pillow device 500 is manufacturable by layering and folding at least one sheet. FIG. 1 shows a pillow bag 150 made from a first sheet 110 and a second sheet 120. The first sheet 110 and the second sheet 120 are aligned and layered together. The first and second sheets 110, 120 have rectangular perimeters which are aligned. In one embodiment the first and second sheets 110, 120 are sewn around three edges of the rectangle leaving an opening into the pillow bag to pass a pillow through and so stuff the pillow bag. In another embodiment which is shown in FIG. 1 the first sheet 110 and the second sheet 120 are sewn together around the four edges of the rectangle to make one combined sheet. The combined sheet 150 has as fold 140 where it is folded in half.

The two lateral sides of the combined sheet 150 are sewn together to make a pillow bag 150. There is an opening 145 into the pillow bag at a distal end from the fold 140.

Figure 2:
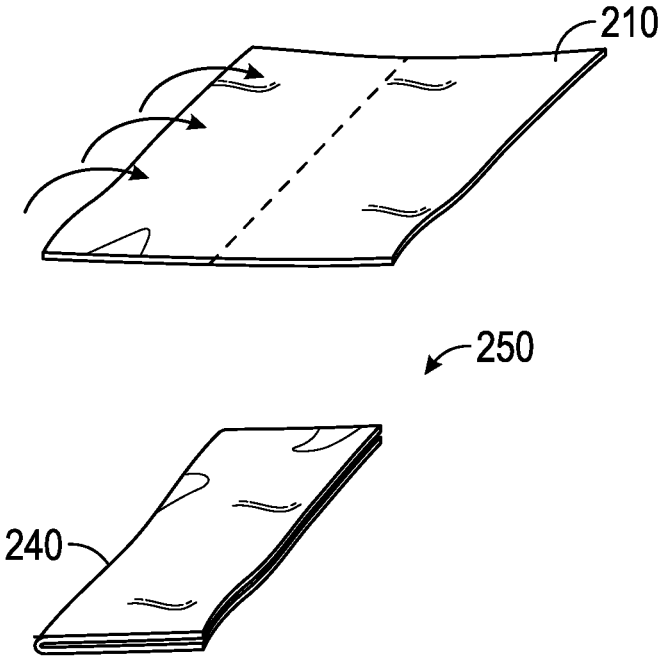
FIG. 2 is a perspective view showing folding a third sheet and forming an exterior pocket being prepared for assembly according to the invention.

FIG. 2 illustrates how a satchel 250 is made for the travel pillow device. Another sheet 210 has a width between lateral sides 212, 214 equal to the width between the lateral sides 112, 114 of the pillow bag 150. The other sheet 210 has a fold 240 where it is folded in half so that fold 240 is perpendicular to the lateral sides 212, 214. The satchel 250 has the same width between its lateral sides 212, 214 as the pillow bag 150 has between its lateral sides 112, 114. The satchel 250 has an opening 245 for goods to pass through which is distal and opposite the fold 240 of the satchel.

Figure 7:
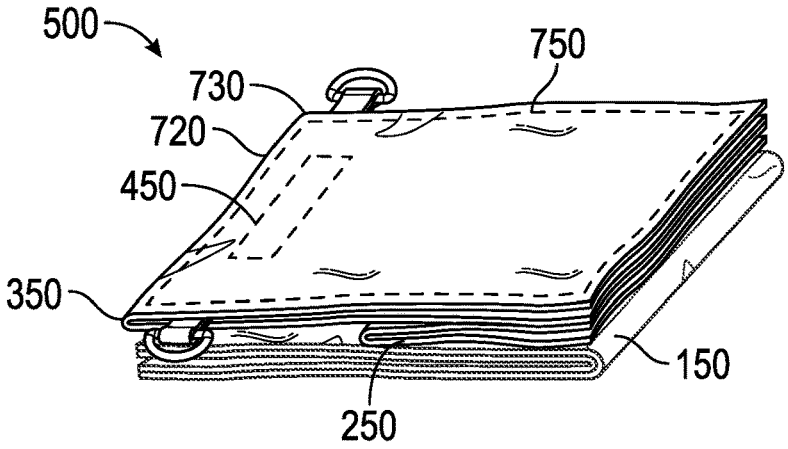
FIG. 7 is a perspective view showing thread a single sewing operation along edges around a perimeter of all sides of a travel pillow device according to the invention.
Figure 8:
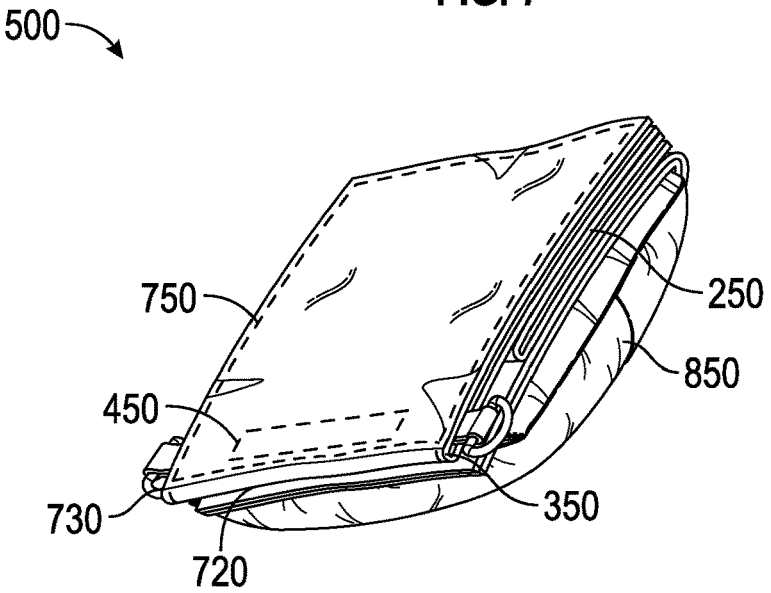
FIG. 8 is a perspective view showing an assembled travel pillow device with pillow stuffing (batting) inserted into a pillow pocket according to the invention.
Figure 9:
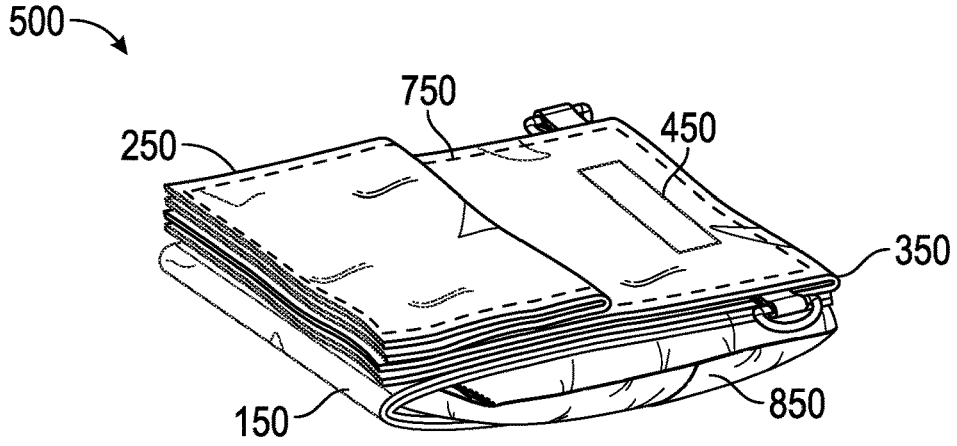
FIG. 9 is a perspective view showing an assembled and stuffed travel pillow device with stuffing secured inside a pillow pocket turned inside out to complete the manufacturer of a travel pillow with pockets according to the invention.

FIG. 7 shows a perspective view of a travel pillow device 500. It is useful for transporting together a pillow and a blanket which are not either included in the travel pillow device as shown in FIG. 7. In use the travel pillow device 50 comprises a pillow 850 as shown in FIG. 8.

Index of Labelled Features in Figures. Features are listed in numeric order by Figure in numeric order.

Referring to the Figures, there is shown in FIG. 1, the following features:

Element 110 which is a first rectangular sheet.

Element 120 which is a second rectangular sheet.

Element 130 which is a single layer comprised of the first rectangular sheet and the second rectangular sheet.

Element 140 which is a folded edge of a pillow bag layer.

Element 150 which is a pillow bag layer.

Referring to the Figures, there is shown in FIG. 2, the following additional features:

Element 210 which is a third rectangular/square sheet.

Element 240 which is a folded edge of the folded third rectangular sheet.

Element 250 which is a folded third rectangular sheet comprising an exterior pocket.

Figure 3:
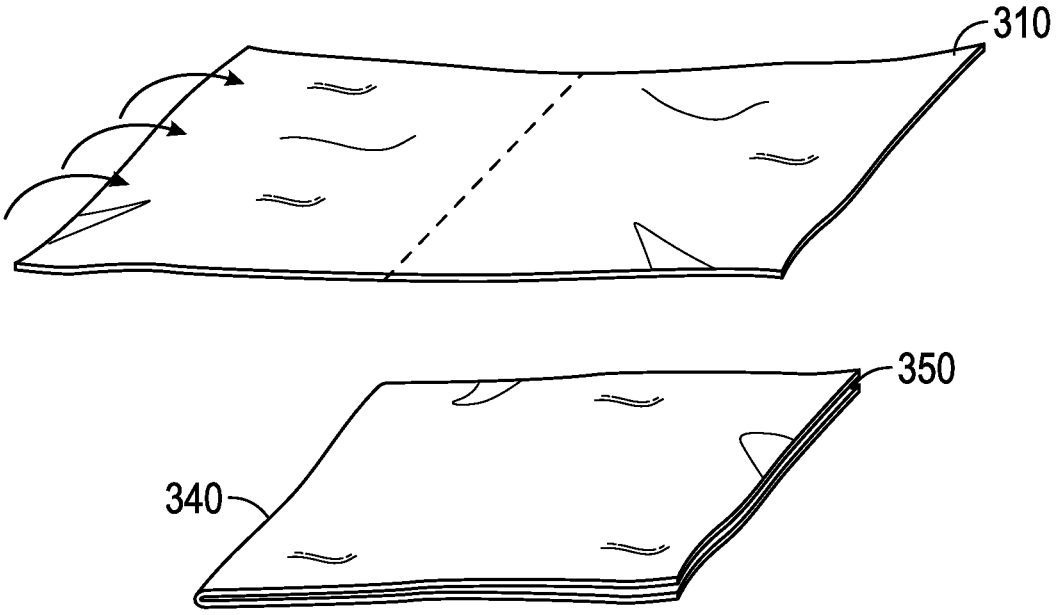
FIG. 3 is a perspective view showing folding a fourth sheet and forming an interior pocket being prepared for assembly according to the invention.

Referring to the Figures, there is shown in FIG. 3, the following additional features:

Element 310 which is a fourth rectangular sheet.

Element 340 which is a folded edge of the folded fourth rectangular sheet.

Element 350 which is a folded fourth rectangular sheet comprising an interior pocket.

Figure 4:
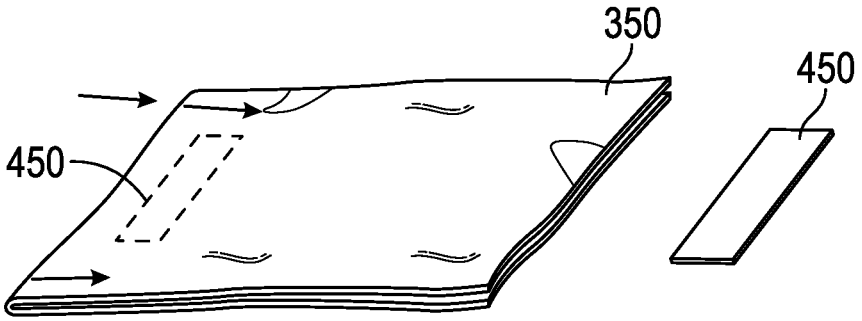
FIG. 4 is a perspective view showing the attachment of a strap to an interior pocket and prepared for assembly according to the invention.

Referring to the Figures, there is shown in FIG. 4, the following additional feature:

Element 450 which is a strap that may be either sewn or ironed-on in place.

Figure 5:
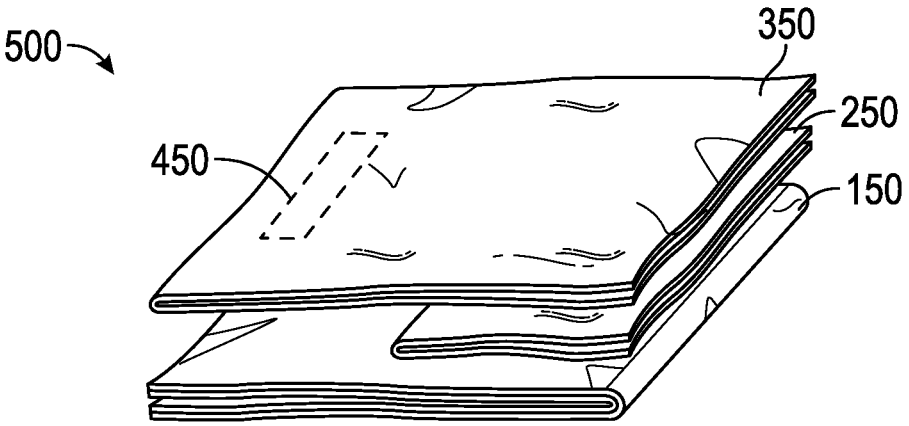
FIG. 5 is a perspective view showing the stacking and alignment of a pillow bag layer including a pillow pocket, a third sheet as folded including an exterior pocket, and fourth sheet as folded including an interior pocket with strap attached for assembly according to the invention.

Referring to the Figures, there is shown in FIG. 5, the following additional feature:

Element 500 which is a travel pillow device.

Referring to the Figures, there is shown in FIG. 7, the following additional features:

Element 720 which is a right side of a pillow stuffing opening.

Element 730 which is a left side of a pillow stuffing opening.

Element 750 which is a single sewing line for a single sewing operation.

Referring to the Figures, there is shown in FIG. 8, the following additional features:

Element 850 which is a pillow stuffing or pillow batting.

Figure 6:
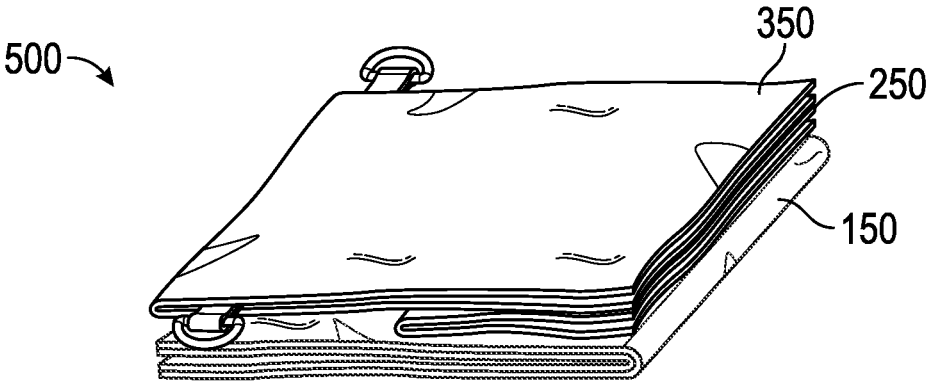
FIG. 6 is a perspective view showing the stacking and alignment of a pillow bag layer including a pillow pocket, a third sheet as folded including an exterior pocket, and a fourth sheet as folded including an interior pocket with strap comprising a pair of attachment devices attached for assembly according to the invention.

FIGS. 1 to 6 illustrate step for making a travel pillow device. In a series of steps shown in FIG. 1 a pillow bag 150 is made. In a series of steps shown in FIG. 2 a satchel 250 is made. In a series of steps shown in FIG. 3 a stowage sack 350 is made. In a step shown in FIG. 4 a strap 450 is added to the stowage sack 350. FIGS. 5 and 6 illustrate how the pillow bag 150, satchel 250, and stowage sack 350 are assembled to make the travel pillow device 500.

FIG. 7 shows a perspective view of a travel pillow device 500. It is useful for transporting together a pillow and a blanket which are not either included in the travel pillow device as shown in FIG. 7.

As shown in FIG. 8 in use the travel pillow device 350 comprises a pillow 850 The travel pillow device 350 has four edges of a rectangle. The pillow bag 150 has a first edge 112, a second edge 114, a third edge 140 where there is a fold 140, and fourth edge 145 where there an opening. The pillow bag has 150 a top side 146 and a bottom side 148. The stowage sack 350 is has a rectangular are dimensioned to match said top side 146 of said pillow 850. The stowage sack is connectively attached to said pillow bag 150 along said respective third edge 140 of the pillow bag and third edge of the stowage bag 350. Said travel pillow device 500 is manufacturable by layering and folding at least one sheet.

FIG. 1 shows a pillow bag 150 made from a first sheet 110 and second sheet 120. Said first sheet and the second sheet 120 are aligned and layered together. Said first and second sheets 110, 120 have rectangular perimeters which are aligned. In one embodiment said first and second sheets 110, 120 are sewn around three edges of the rectangle leaving an opening into the pillow bag to pass a pillow through and so stuff the pillow bag. In another embodiment which is shown in FIG. 1 said first sheet 110 and the second sheet 120 are sewn together around the four edges of the rectangle to make one combined sheet. Said combined sheet 150 has as fold 140 where it is folded in half. The two lateral sides of the combined sheet 150 are sewn together to make a pillow bag 150. There is an opening 145 into the pillow bag at a distal end from the fold 140.

Said stowage sack 350 has an opening for stowage along a fourth edge 345 opposite its fold 340.

FIG. 2 illustrates how a satchel 250 is made for said travel pillow device. FIG. 2 illustrates how a satchel 250 is made for the travel pillow device. Another sheet 210 has a width between lateral sides 212, 214 equal to the width between the lateral sides 112, 114 of the pillow bag 150. The other sheet 210 has a fold 240 where it is folded in half so that fold 240 is perpendicular to the lateral sides 212, 214. The satchel 250 has the same width be-tween its lateral sides 212, 214 as the pillow bag 150 has between its lateral sides 112, 114. The satchel 250 has an opening 245 for goods to pass through which is distal and opposite the fold 240 of the satchel.

FIGS. 6, 7, 8 and 9 show said satchel 250 is connectively attached to said stowage sack 350 However said satchel 250 is an option in the travel pillow device 500. In some embodiments of said travel pillow device 500 there is no satchel. A strap 450 is connectively attached to said stowage sack 350.

Figure 10:
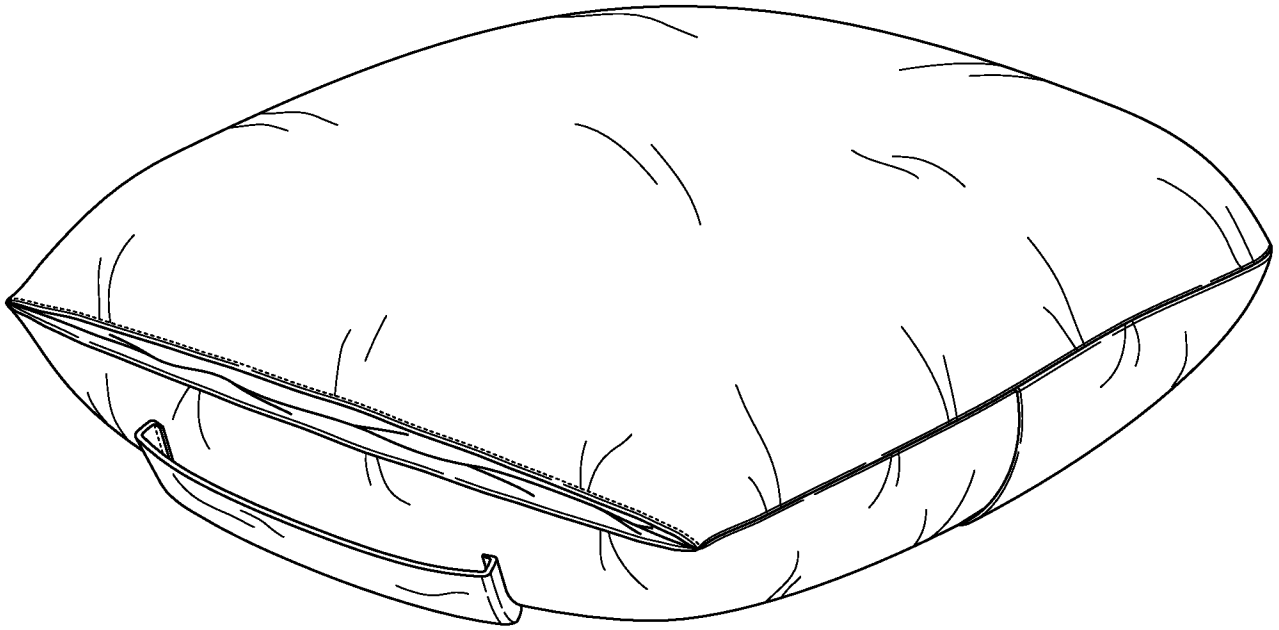
FIG. 10 is a perspective view of the travel pillow device comprising a pillow bag and a stowage sack in a first configuration.
Figure 11:
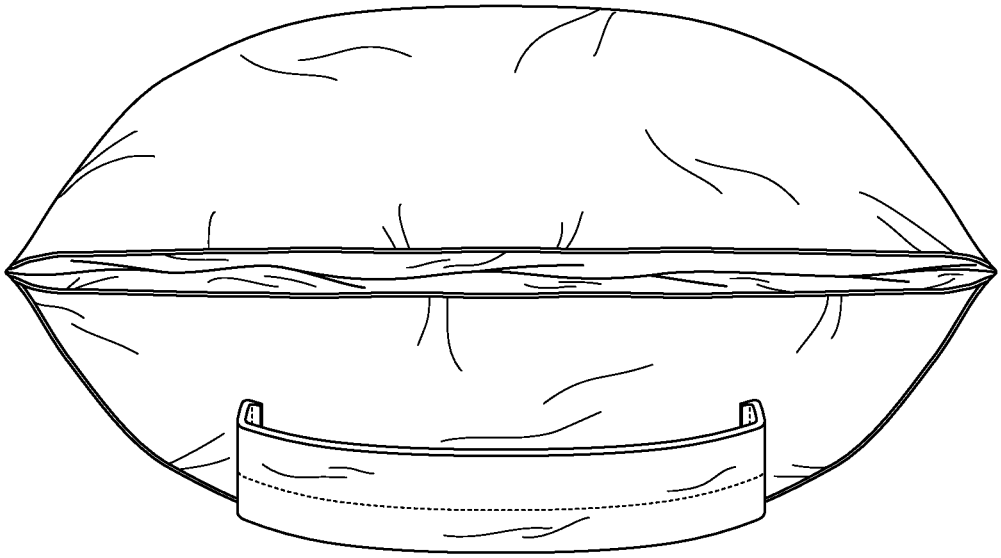
FIG. 11 is a perspective view of the travel pillow device comprising a pillow bag and a stowage sack in a second configuration.
Figure 12:
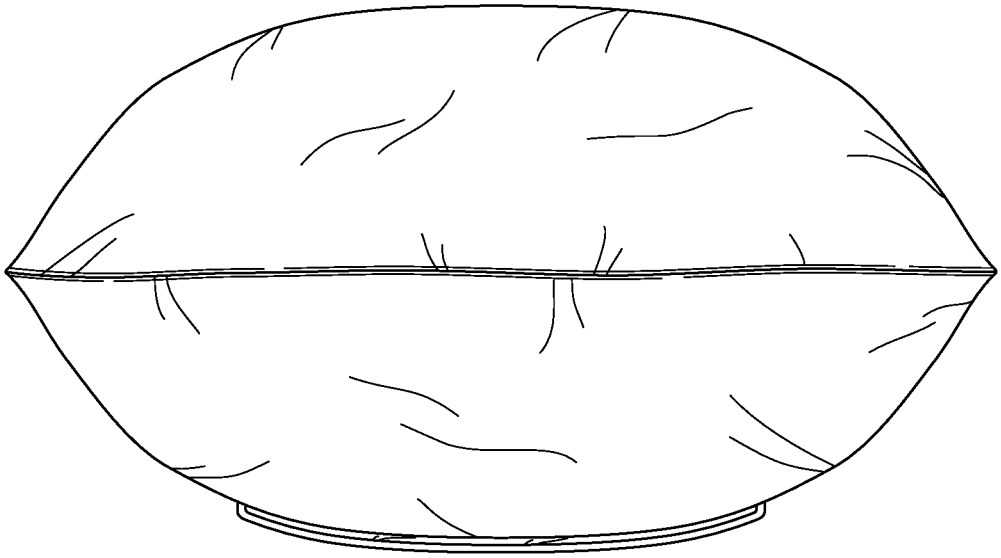
FIG. 12 is perspective top view showing a square travel pillow device with pockets.
Figure 13:
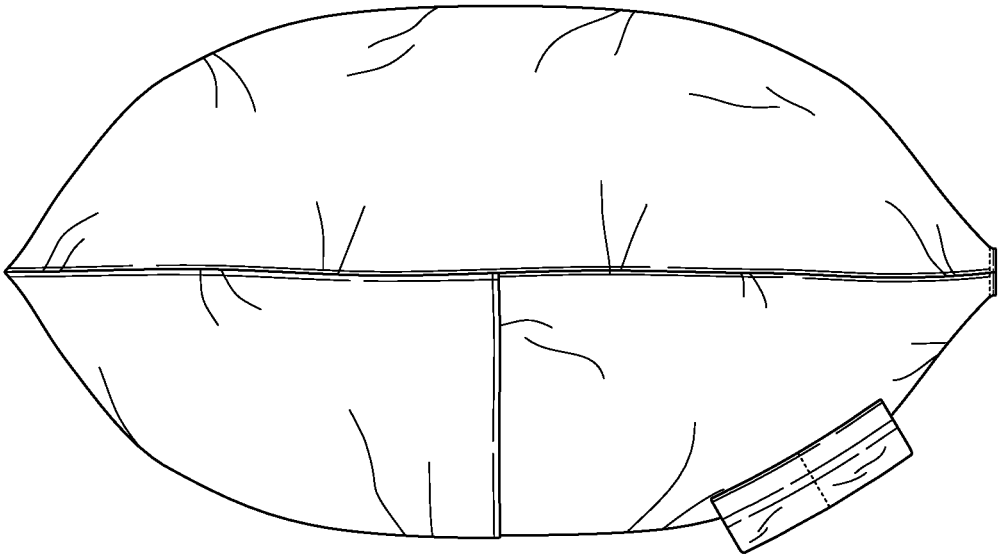
FIG. 13 is right side view showing a square travel pillow device with pockets.
Figure 14:
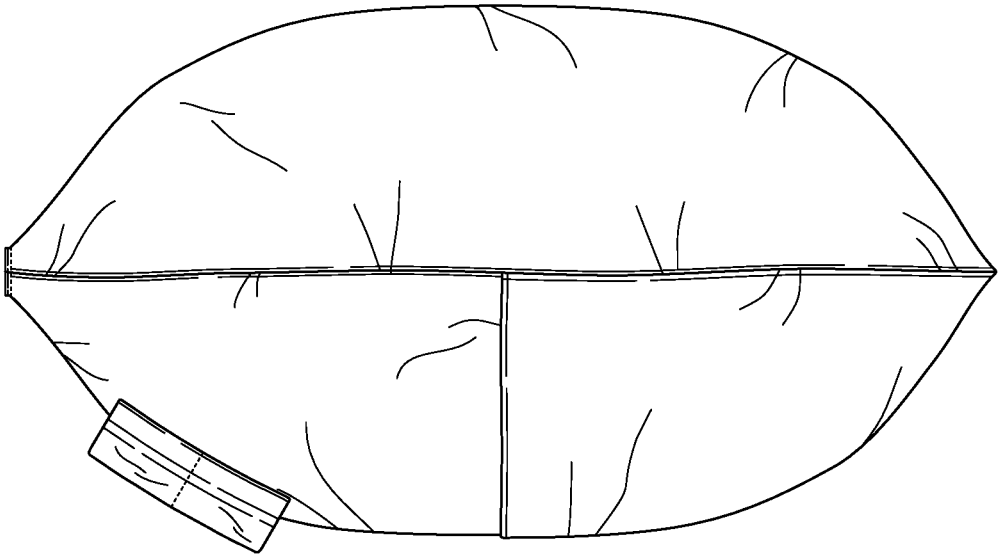
FIG. 14 is left side view showing a square travel pillow device with pockets.
Figure 15:
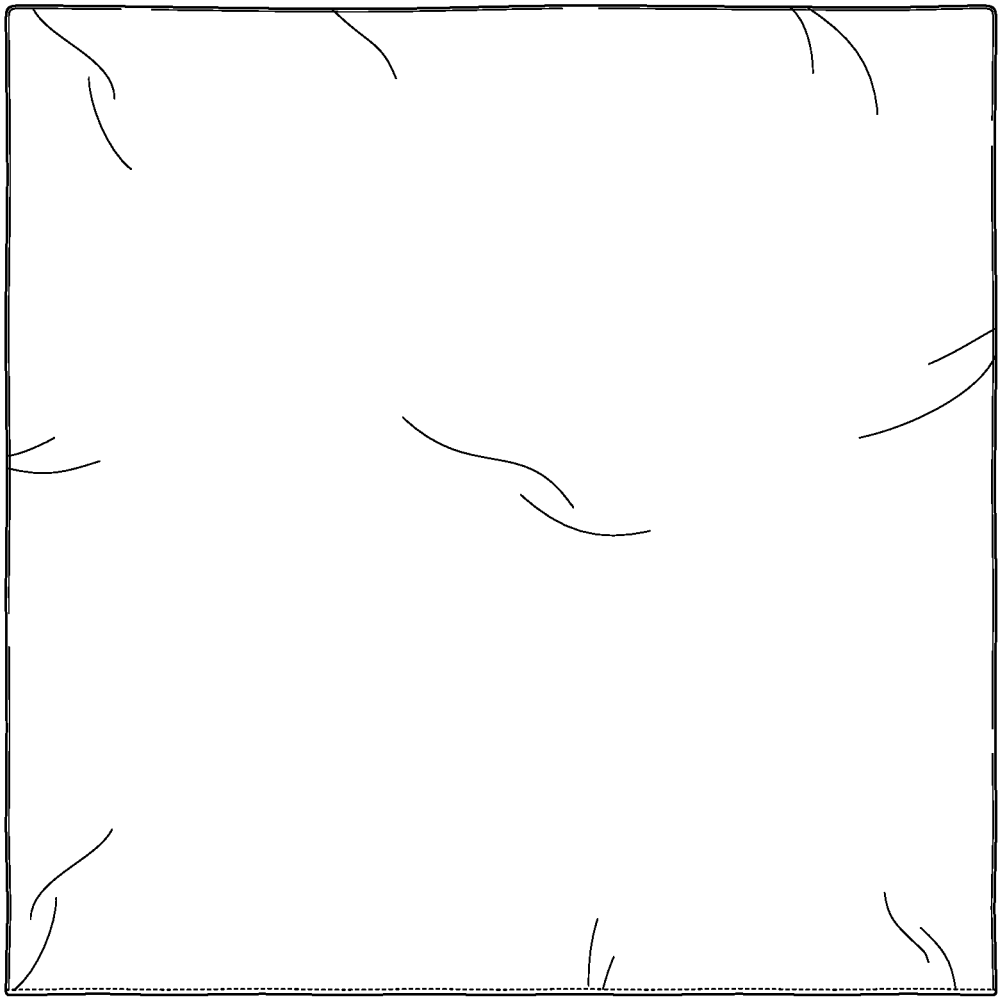
FIG. 15 is front side view showing a square travel pillow device with pockets.
Figure 16:
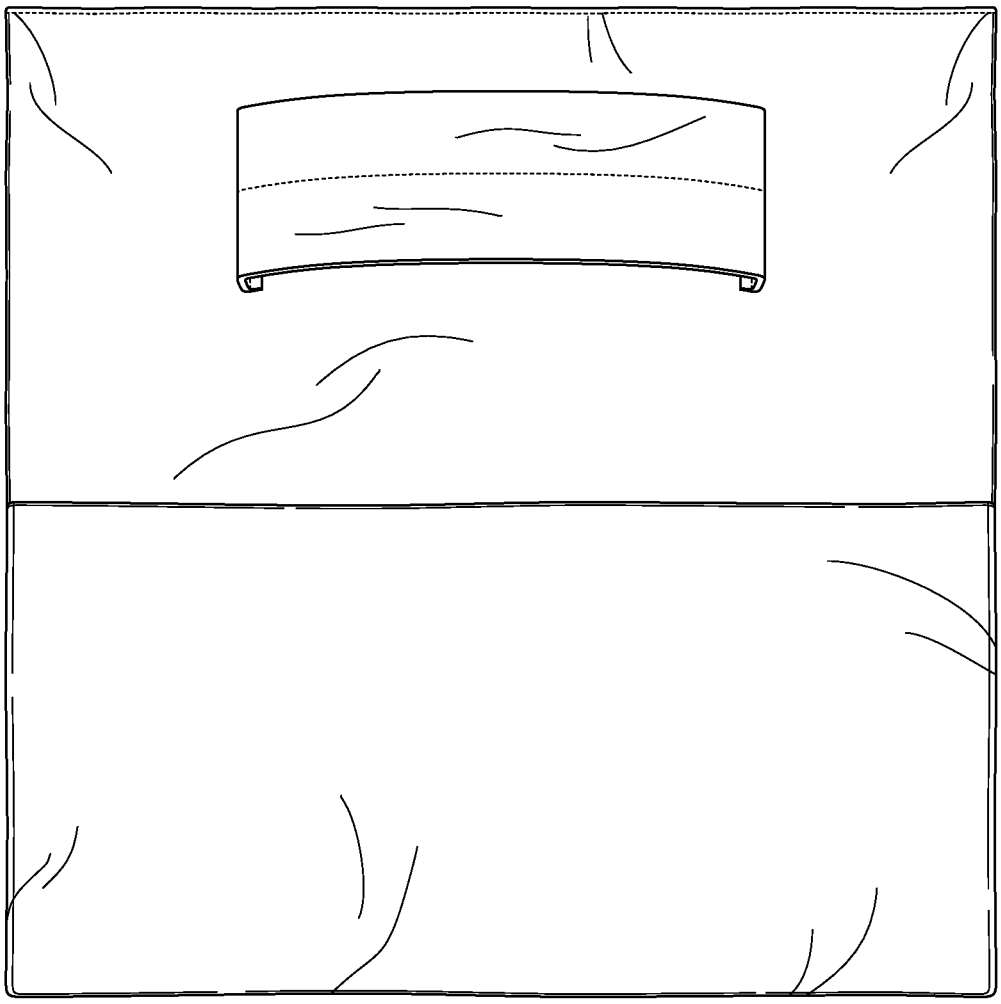
FIG. 16 is back side view showing a square travel pillow device with pockets.
Figure 17:
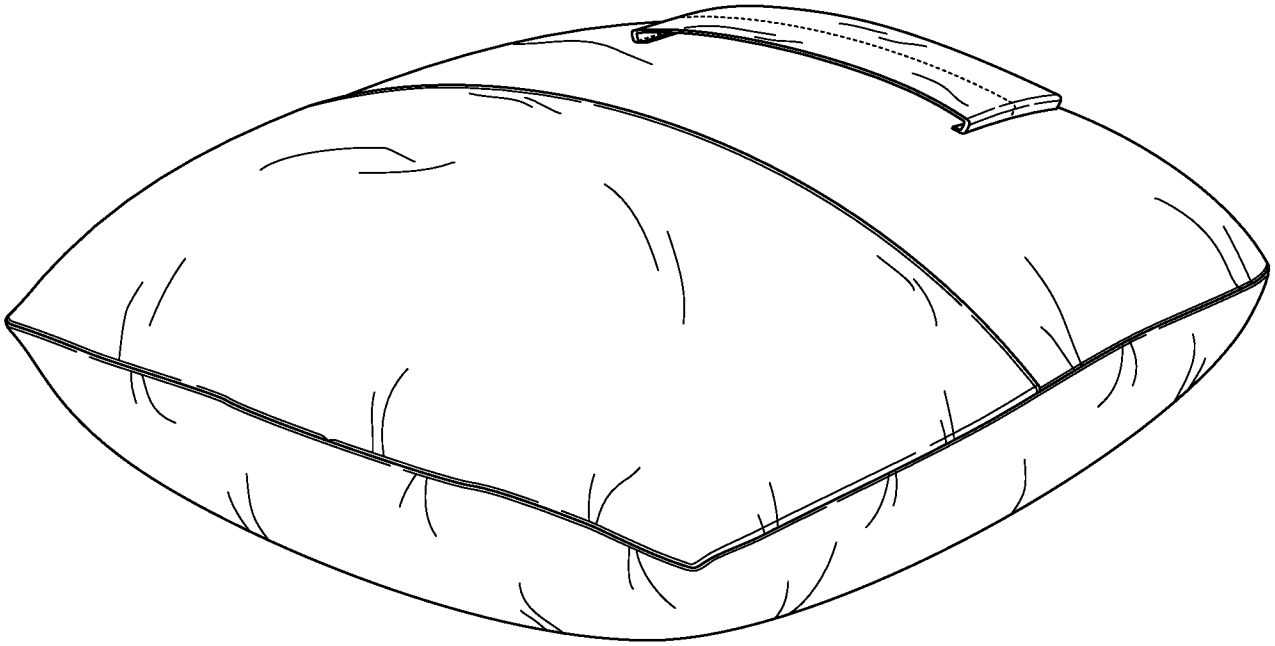
FIG. 17 is top side view showing a square travel pillow device with pockets.
Figure 18:
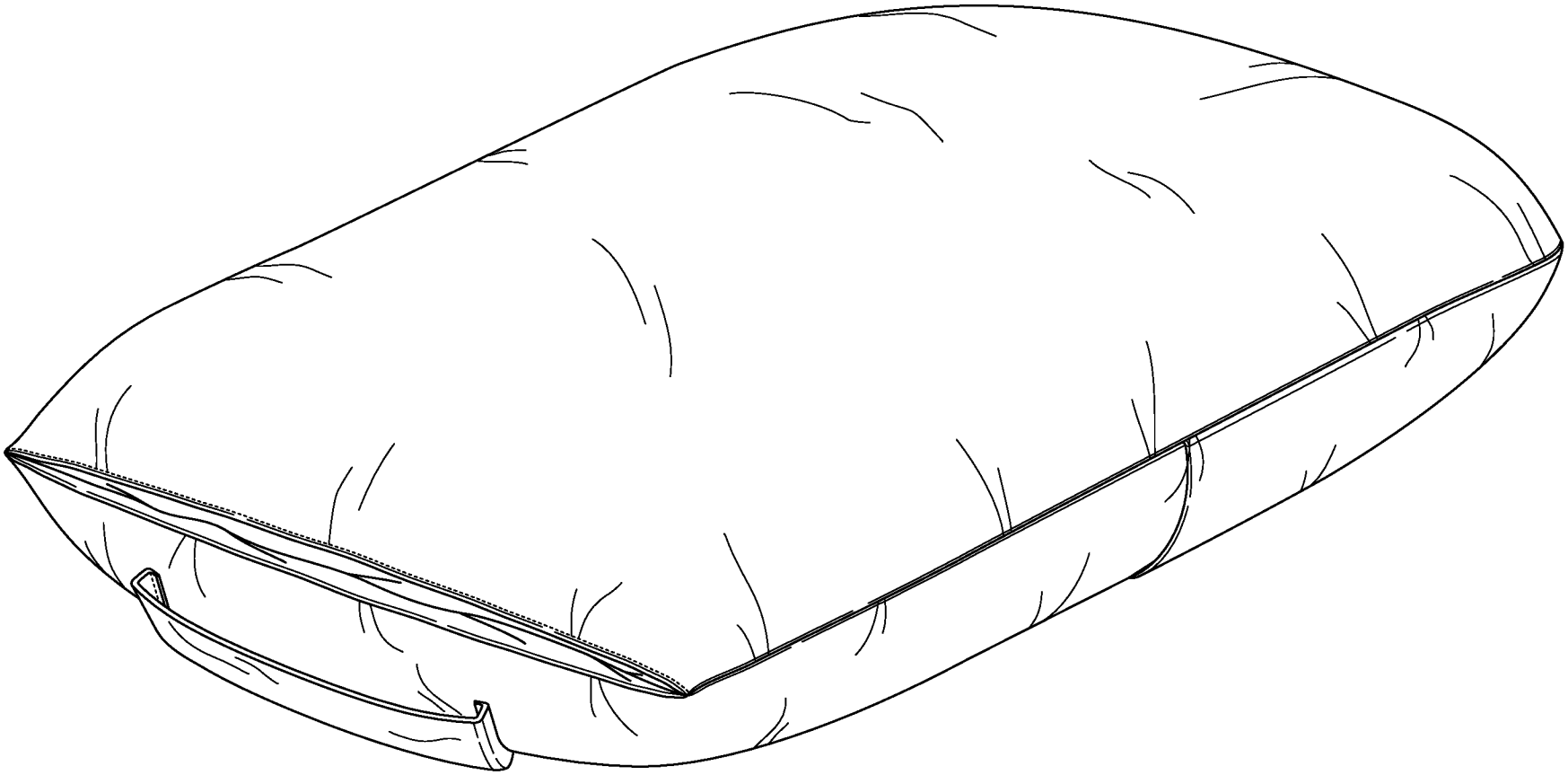
FIG. 18 is bottom side view showing a square travel pillow device with pockets.
Figure 19:
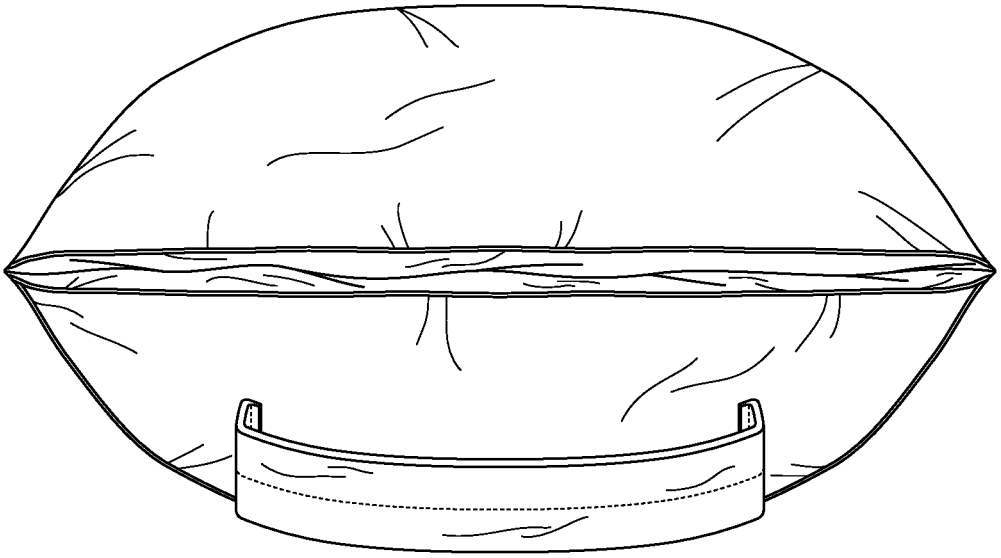
FIG. 19 is perspective bottom view showing a square travel pillow device with pockets.
Figure 20:
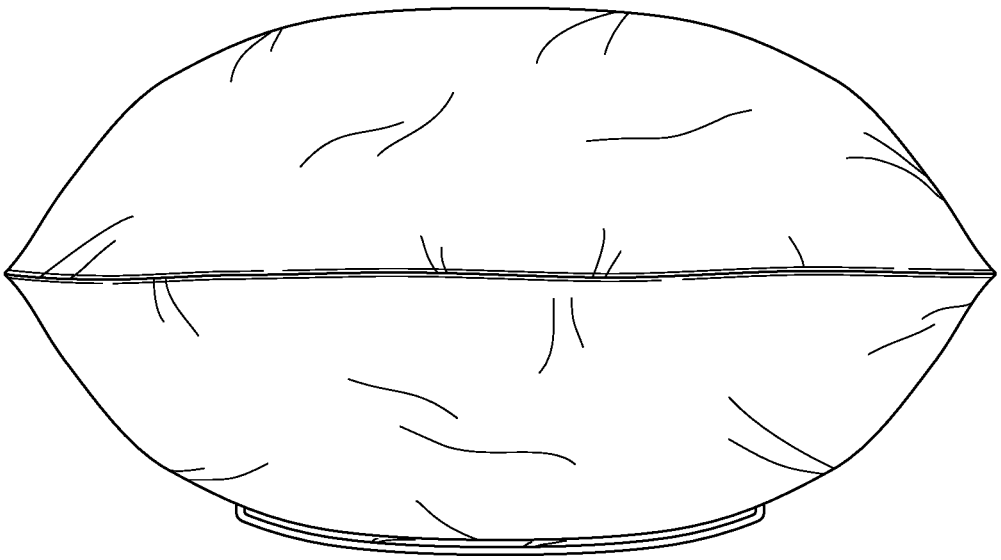
FIG. 20 is perspective top view showing a rectangular travel pillow device with pockets open on a short edge.
Figure 21:
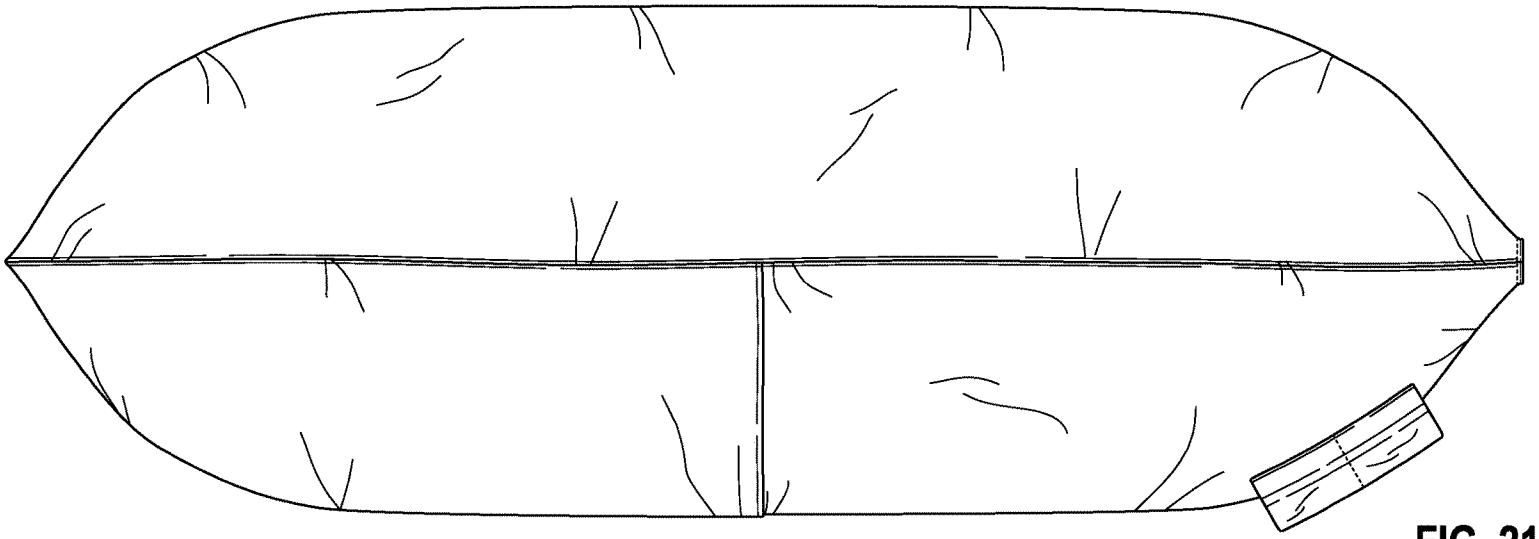
FIG. 21 is right side view showing a rectangular travel pillow device with pockets open on a short edge.
Figure 22:
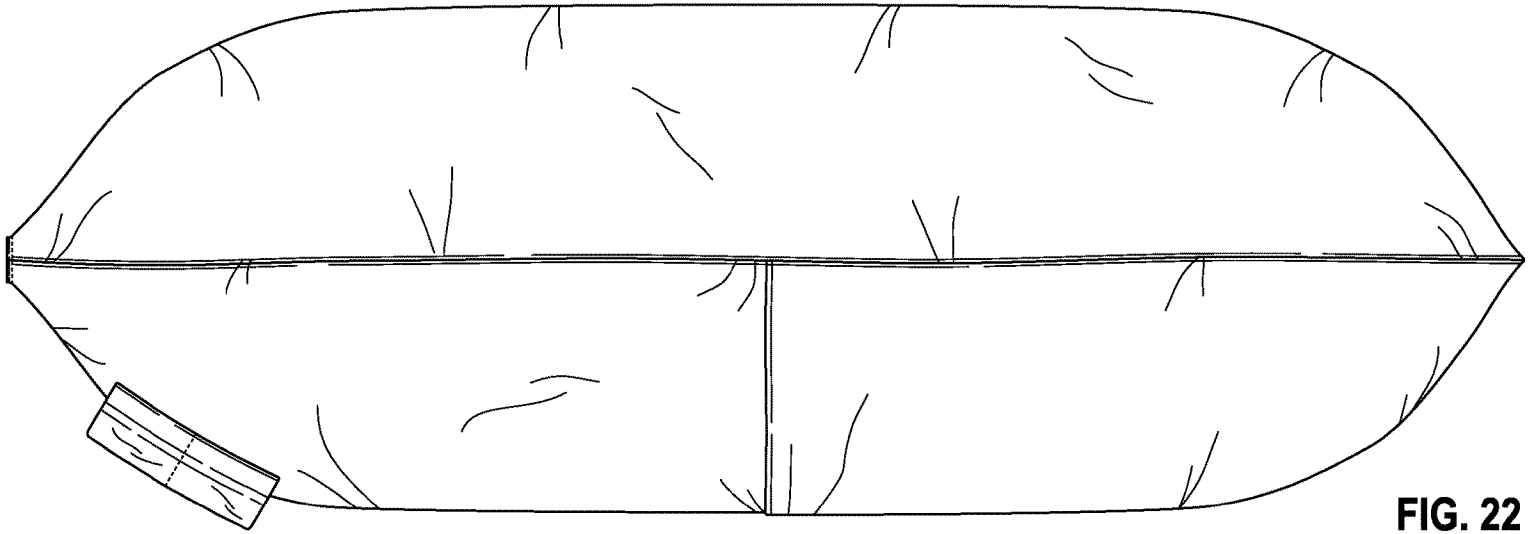
FIG. 22 is left side view showing a rectangular travel pillow device with pockets open on a short edge.
Figure 23:
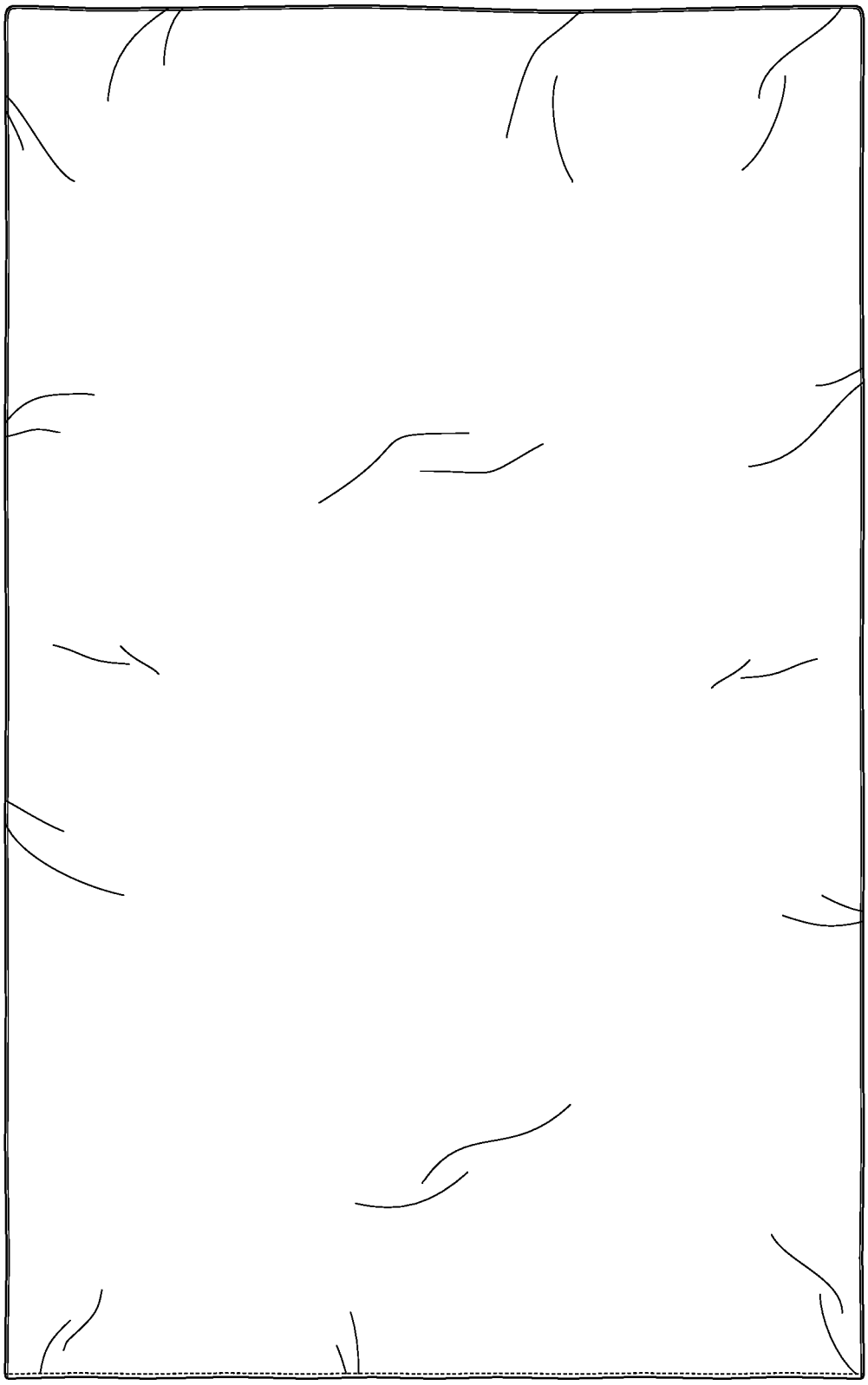
FIG. 23 is front side view showing a rectangular travel pillow device with pockets open on a short edge.
Figure 24:
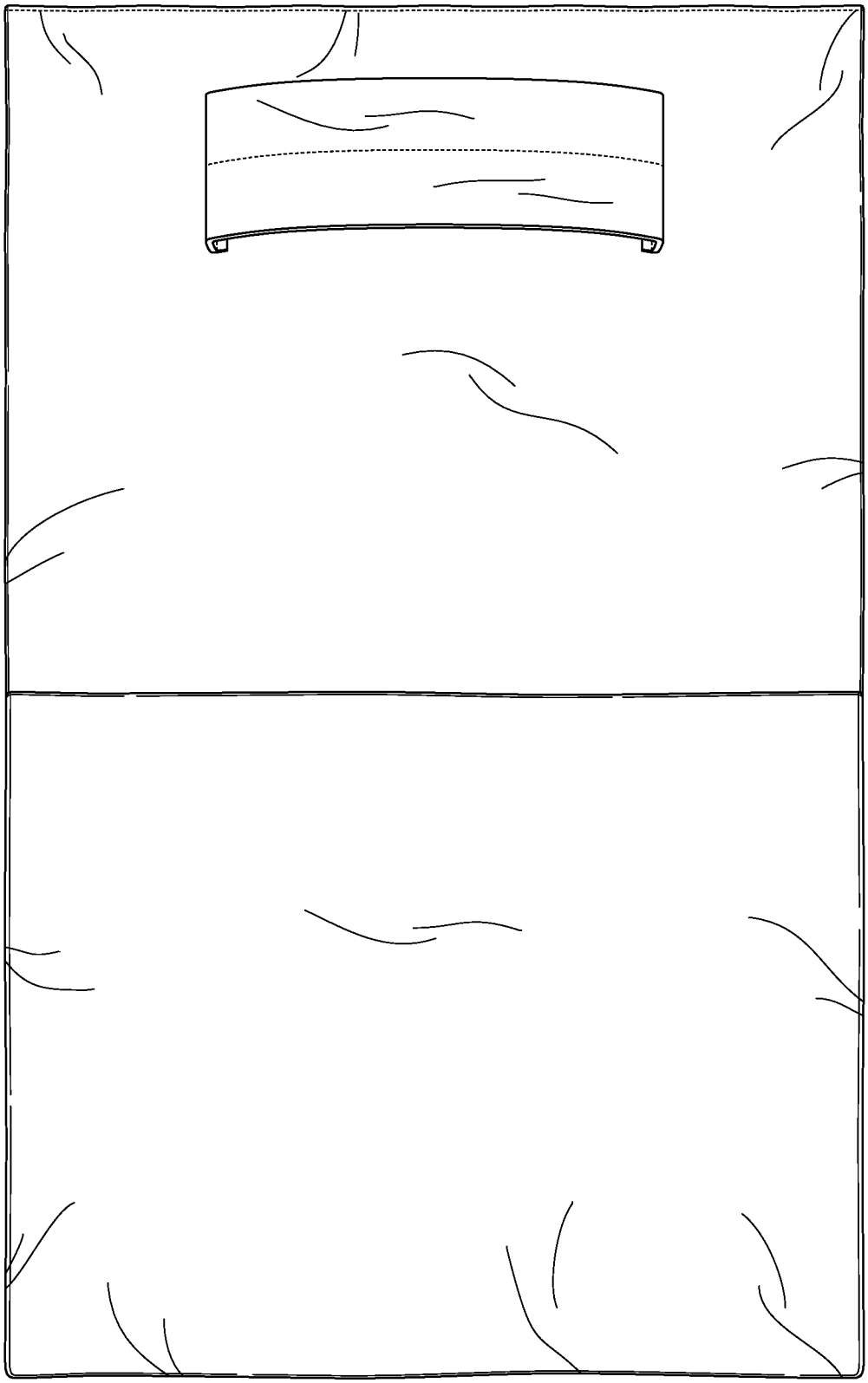
FIG. 24 is back side view showing a rectangular travel pillow device with pockets open on a short edge.
Figure 25:
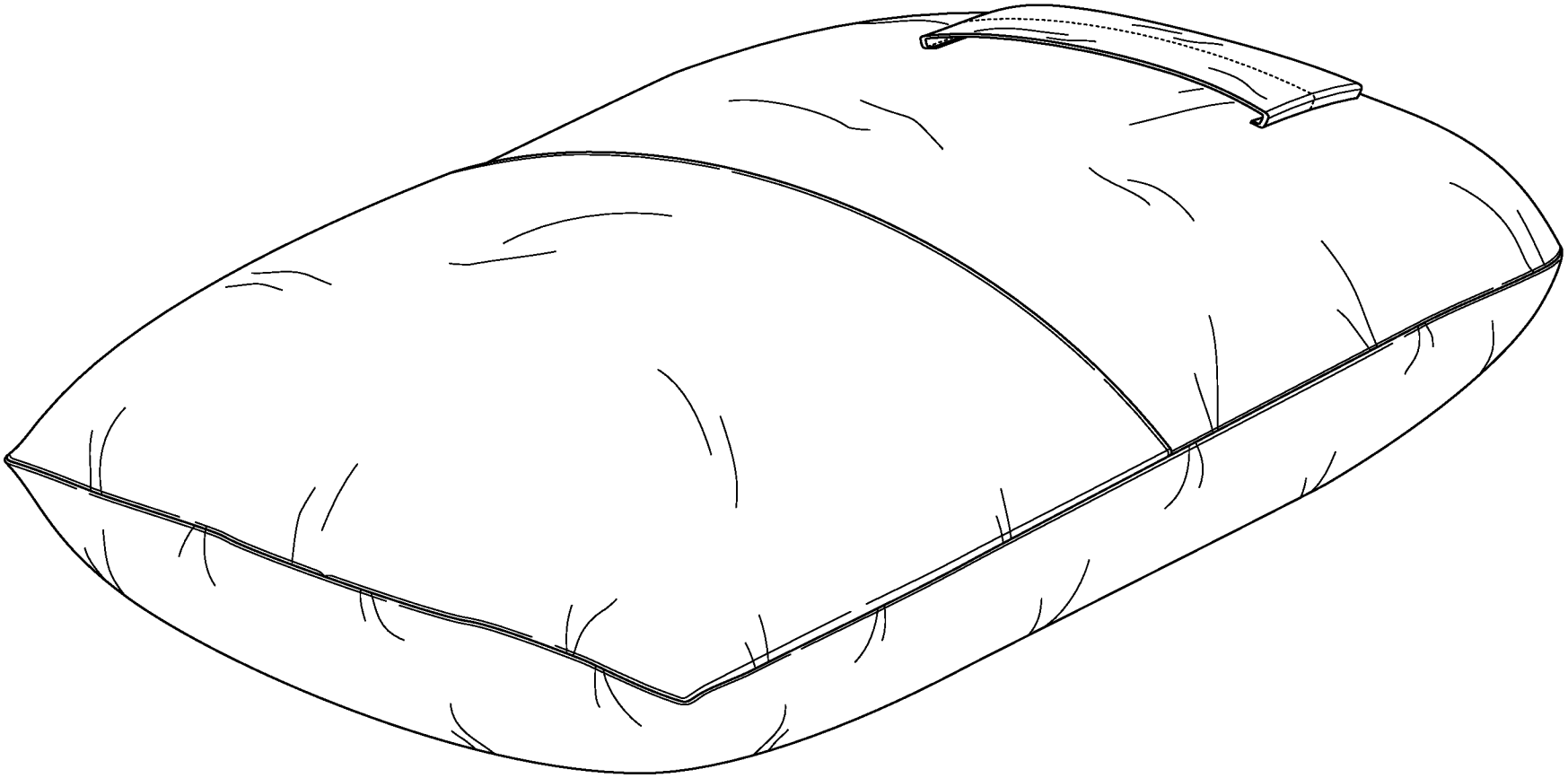
FIG. 25 is top side view showing a rectangular travel pillow device with pockets open on a short edge.
Figure 26:
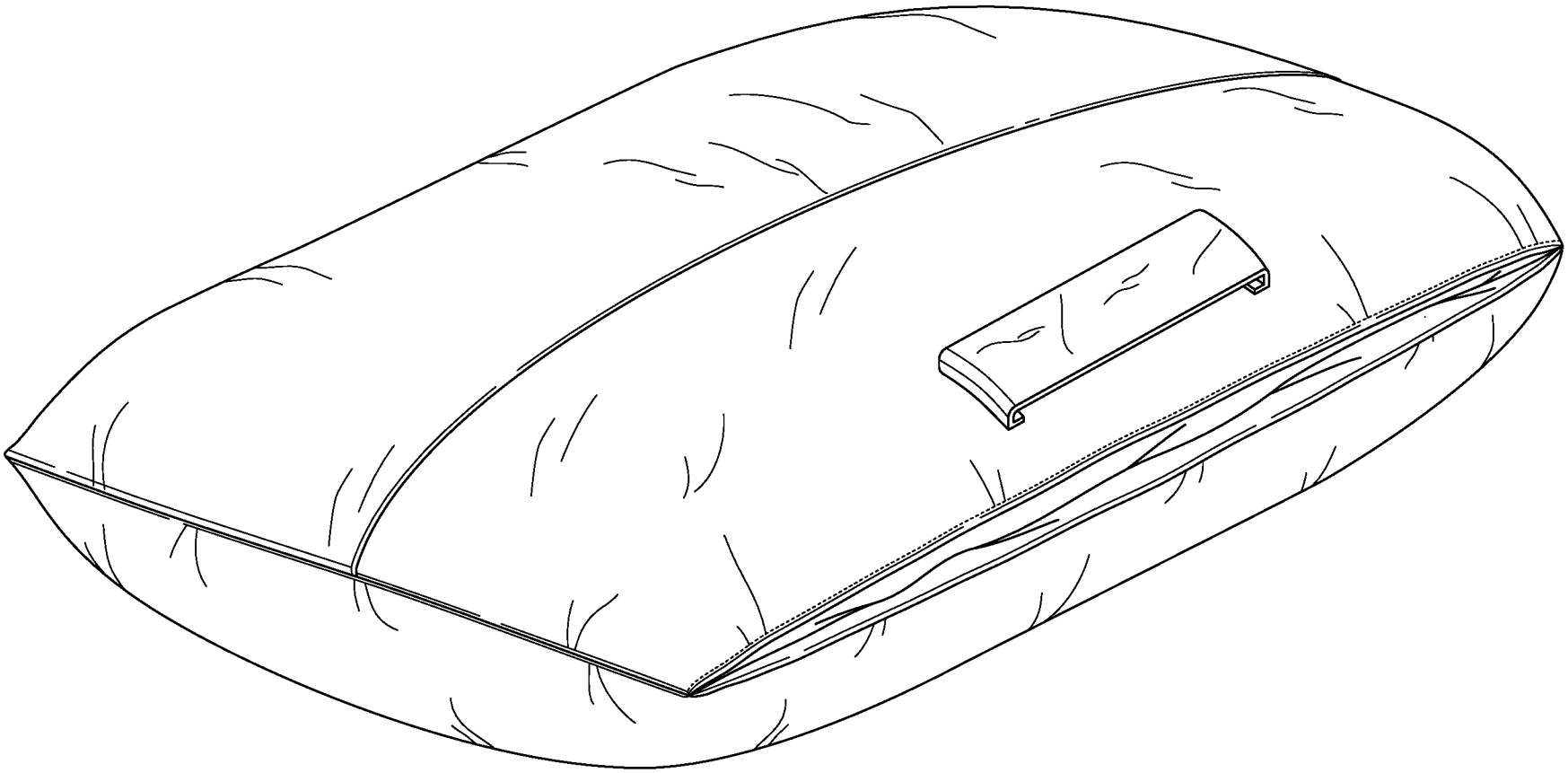
FIG. 26 is bottom side view showing a rectangular travel pillow device with pockets open on a short edge.
Figure 27:
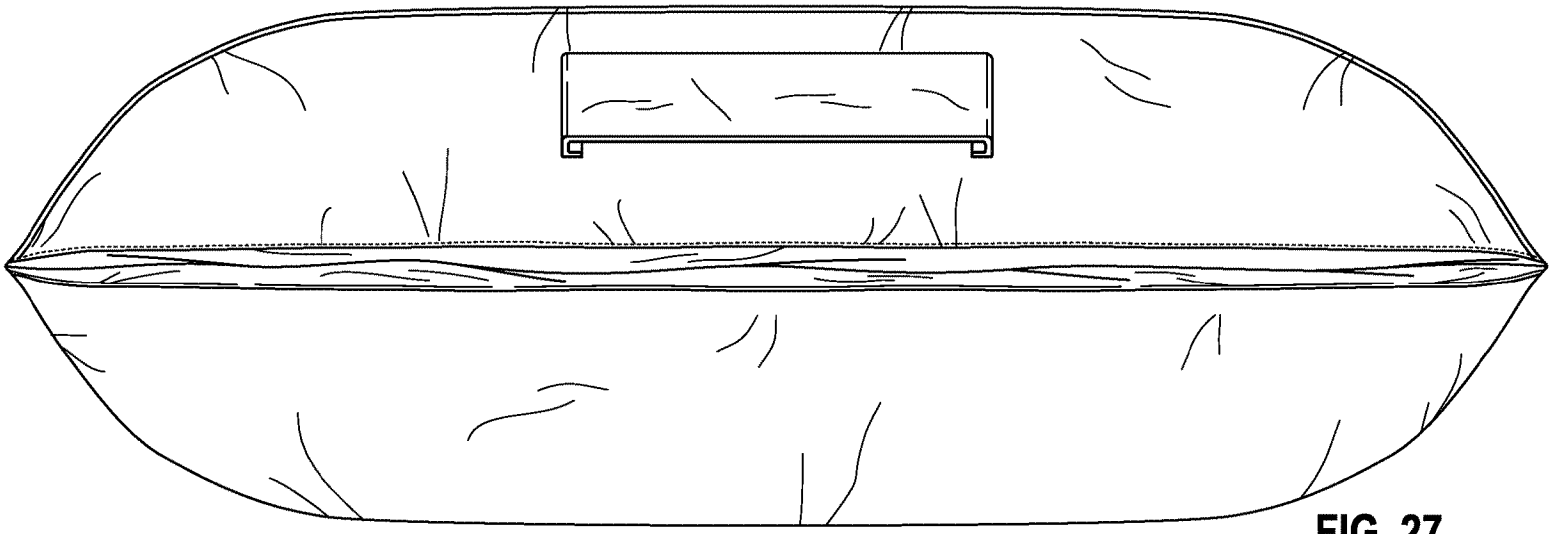
FIG. 27 is perspective bottom view showing a rectangular travel pillow device with pockets open on a long edge.
Figure 28:
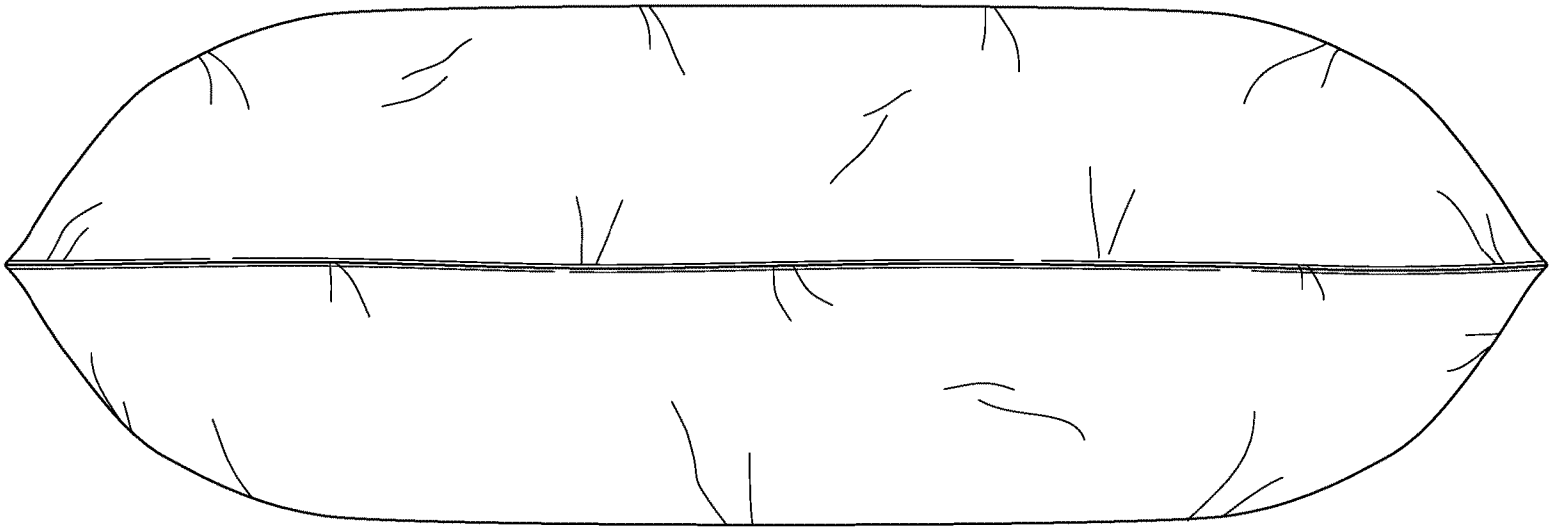
FIG. 28 is right side view showing a rectangular travel pillow device with pockets open on a long edge.
Figure 29:
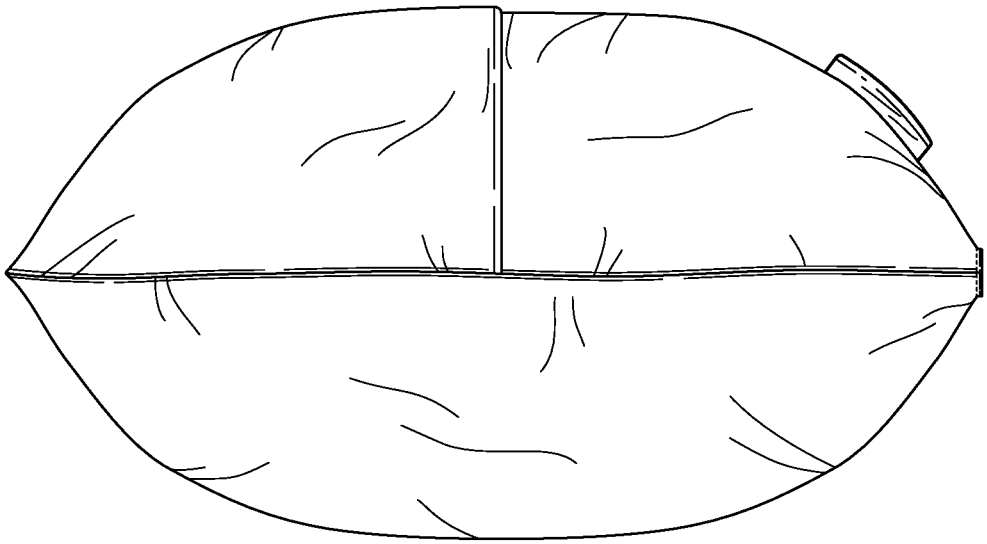
FIG. 29 is left side view showing a rectangular travel pillow device with pockets open on a long edge.
Figure 30:
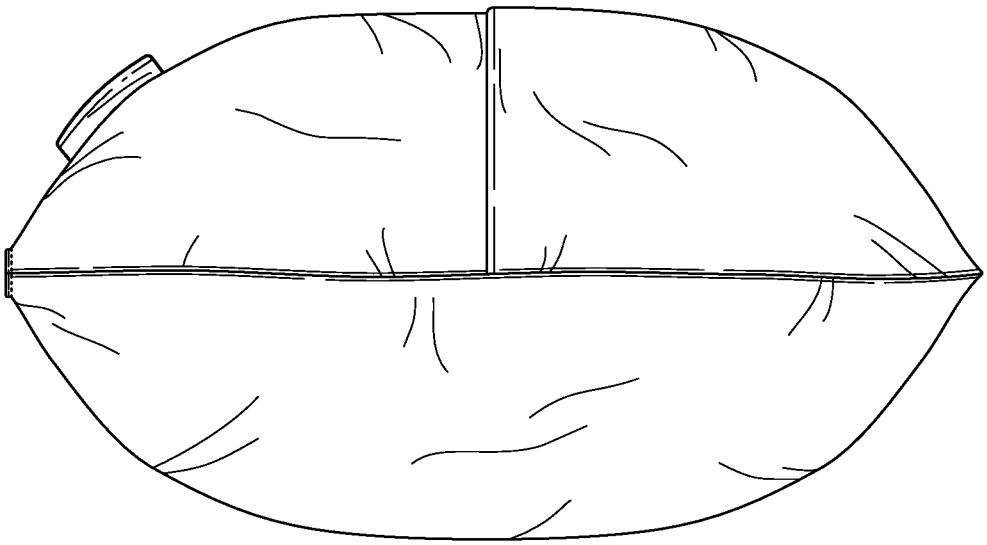
FIG. 30 is front side view showing a rectangular travel pillow device with pockets open on a long edge.
Figure 31:
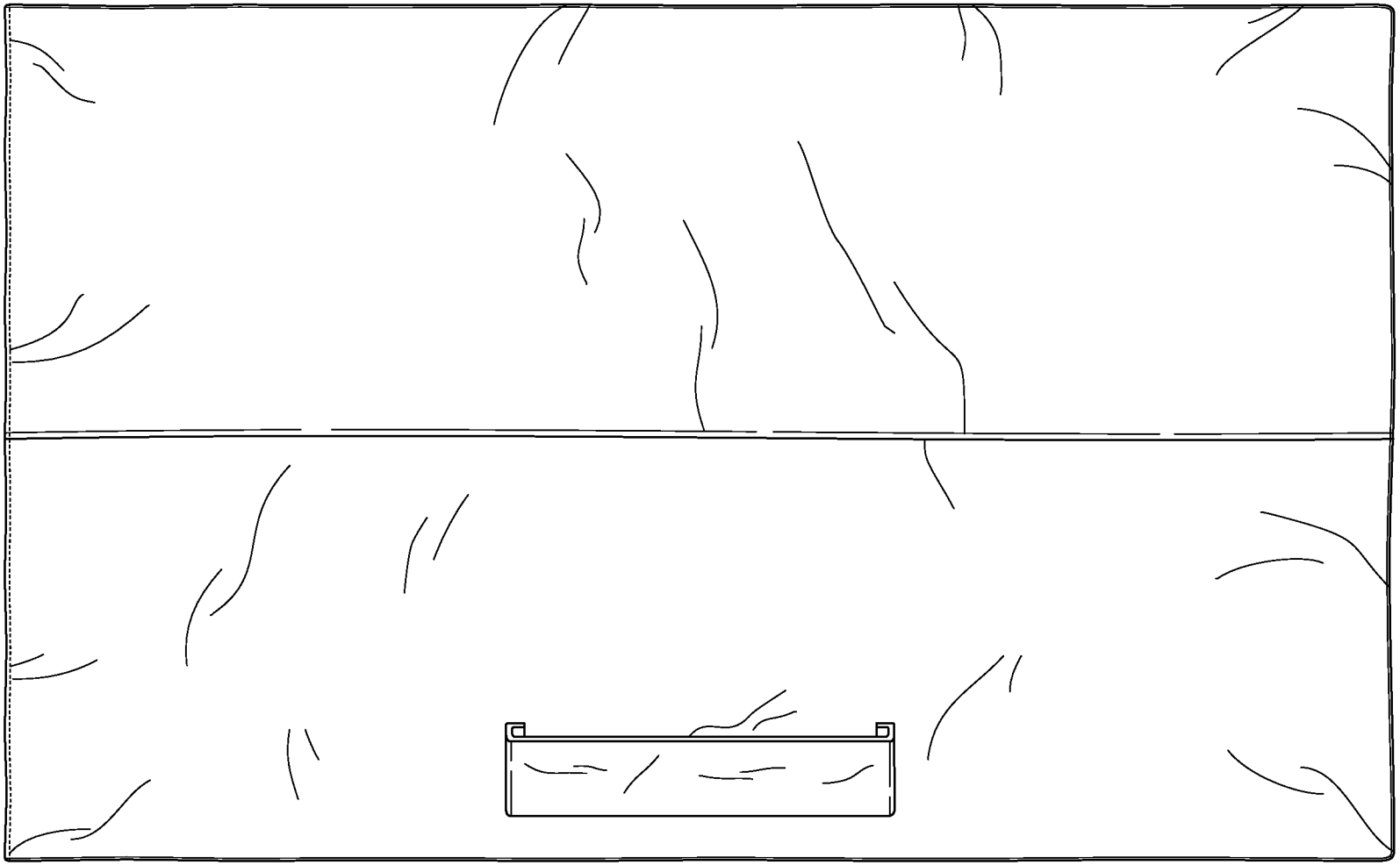
FIG. 31 is back side view showing a rectangular travel pillow device with pockets open on a long edge.
Figure 32:
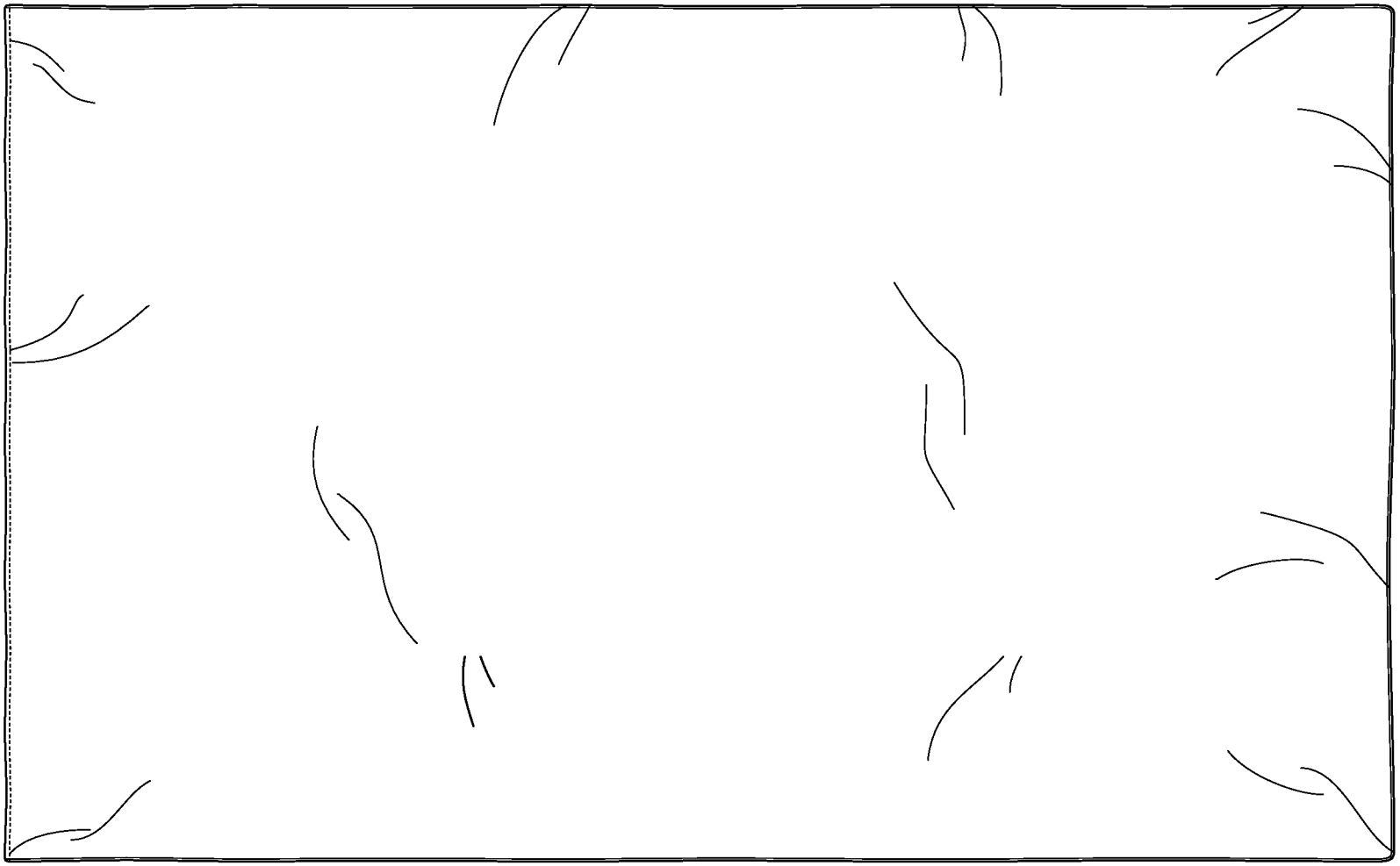
FIG. 32 is back side view showing a rectangular travel pillow device with pockets open on a long edge.
Figure 33:
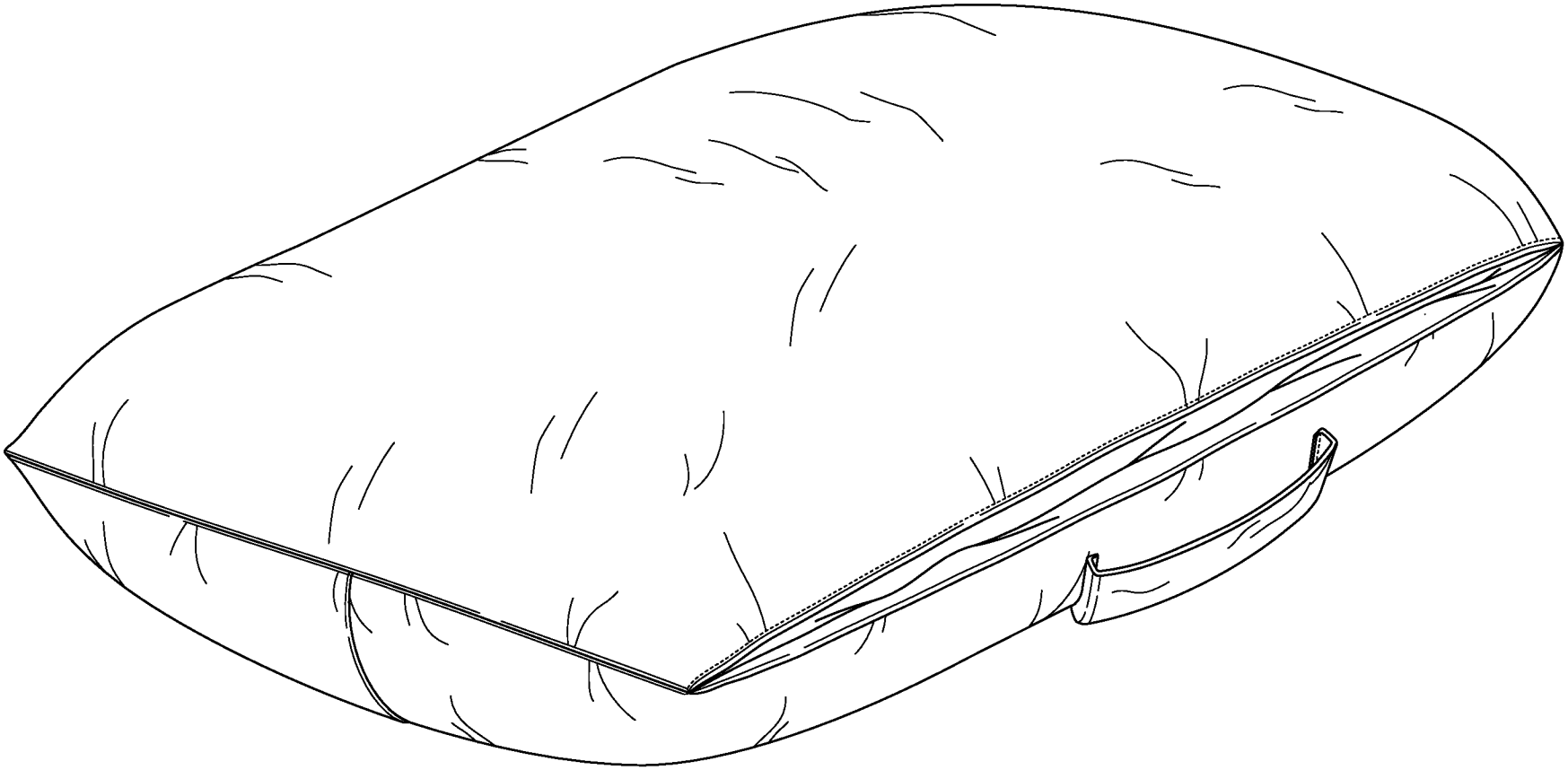
FIG. 33 is top side view showing a rectangular travel pillow device with pockets open on a long edge.

FIGS. 10 and 11 show an embodiment of the travel pillow bag 500 without a satchel 250. FIG. 10 shows the travel pillow bag in a first configuration in which a reversible surface 352 of the stowage sack 350 is turned inside-out to uncover the opening 145 to pass through the pillow 850 into the pillow bag 150. The reversible surface 352 of the stowage sack 350 is attached to the pillow bag 150 along an edge of the opening 145 to pass through the pillow 850. There is an attachment made of stitches, a zip, and/or buttons long the edge of the opening 145 which attaches to the stowage sack 350 along the fold 340 of the stowage sack 350 distal from the opening 345 in the stowage sack 345.

FIG. 10 shows the pillow 850 external to the pillow storage 150 to be inserted through the opening 145 to pass through the pillow 850 into the pillow bag. FIG. 10 also shows the reversible surface 352 of the stowage sack 350 so the reversible surface is a storage surface.

FIG. 11 shows the pillow 850 in the pillow bag 150 captured inside the stowage sack 350. The opening 345 of the stowage sack 350 is sized large enough or stretchable large enough to pass the pillow bag 150 through it even with the pillow bag 150 filled with the pillow 850. After the pillow 850 is inserted into the pillow bag 150, then the pillow bag 150 is inserted into the stowage sack 350 by passing through the opening 345 in the stowage sack 350. This turns the stowage sack 350 outside-in so that the reversible surface 350 is the inside surface.

So in consideration of FIGS. 1 to 11 there is a method of manufacturing a travel pillow device 500 including aligning and layering together a pillow bag 150 and a stowage sack 350. The pillow bag 150 has an opening 145 to pass through a pillow 850. The stowage sack 350 has an opening 345 to pass though the pillow bag 150. The method includes attaching a reversible surface 352 of the stowage sack 350 turned outwards to an attachment on the pillow bag 150. The attachment is along an edge of the opening 145 into the pillow bag 150. The method includes inserting the pillow 850 into the pillow bag 150 through the opening 145 to pass through the pillow 850. The method includes turning the stowage sack 350 inside-out over the pillow bag 150 to cover the opening 145 of the pillow bag 150. The pillow 850 is captured inside the pillow bag 150 and cannot fall out because the opening 145 of the pillow bag 150 is covered by the stowage sack 350.

The strap 450 with buckles or rings 452, 454 at its ends is affixed to a surface of the stowage sack on an opposite side from the reversible surface proximate the opening of the stowage sack to pass through the pillow bag. So when the stowage sack 350 is turned outside-in, the strap 450 is on the exterior of the stowage sack 350 and travel pillow device 500. So conveniently for a traveler, the travel pillow device 500 can be buckled or connected by the rings to the luggage or it may be used as shoulder strap or belt.

The invention has been described by way of examples only. Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the claims.

Although the invention has been explained in relation to various embodiments, it is to be understood that many other possible modifications and variations can be made without departing from the spirit and scope of the invention.

The invention claimed is:

1. A travel pillow device for transporting a pillow and blanket, comprising: a pillow bag having an opening to pass through a pillow, and a stowage sack having an opening to pass through said pillow bag and a reversible surface, wherein said pillow bag has a first attachment connected to said reversible surface which turns outside-in to cover said opening of said pillow bag comprising a satchel having an opening to in-take goods and a second attachment connected to said reversible surface of said pillow bag proximate said first attachment.

2. The travel pillow device according to claim 1 wherein a second configuration of said reversible surface of said stowage sack is turned outside-in to interleave said satchel intermediate said pillow bag and said reversible surface.

3. A travel pillow device for transporting a pillow and blanket, comprising: a pillow bag having an opening to pass through a pillow, and a stowage sack having an opening to pass through said pillow bag and a reversible surface, wherein said pillow bag has a first attachment to said reversible surface which turns outside-in to cover said opening of said pillow bag wherein said stowage sack comprises a second fabric sheet having a second fold where said second fabric sheet is folded in half, wherein said first attachment is aligned along said second fold.

4. A travel pillow device for transporting a pillow and blanket, comprising: a pillow bag having an opening to pass through a pillow and a stowage sack having an opening to pass through said pillow bag and a reversible surface wherein said pillow bag has a first attachment to said reversible surface which turns outside-in to cover said opening of said pillow bag which comprises a first fabric sheet having a first fold where said first fabric sheet is folded in half, wherein said first attachment is aligned along said first fold, wherein said stowage sack comprises a second fabric sheet having a second fold where said second fabric sheet is folded in half and wherein said second fold is aligned along said first fold.

* * * * *